US005729800A

United States Patent [19]

Ohba et al.

[11] Patent Number: 5,729,800

[45] Date of Patent: Mar. 17, 1998

[54] ELECTROPHOTOGRAPHIC APPARATUS HAVING AN A-SI PHOTOSENSITIVE DRUM ASSEMBLED THEREIN

[75] Inventors: Tadashi Ohba; Norio Tomiie; Keiji Itsukushima, all of Tokyo; Hisashi Higuchi, Shiga, all of Japan

[73] Assignee: Kyocera Corporation, Tokyo, Japan

[21] Appl. No.: 332,481

[22] Filed: Oct. 27, 1994

[30] Foreign Application Priority Data

| | | | |
|---|---|---|---|
| Oct. 29, 1993 | [JP] | Japan | 5-294359 |
| Oct. 29, 1993 | [JP] | Japan | 5-294365 |
| Jul. 29, 1994 | [JP] | Japan | 6-197225 |
| Jul. 29, 1994 | [JP] | Japan | 6-198001 |

[51] Int. Cl.[6] ..... G03G 15/02

[52] U.S. Cl. ..... 399/159; 399/168; 430/84; 430/902

[58] Field of Search ..... 355/211, 219; 430/66, 902, 65, 84; 399/159, 168

[56] References Cited

U.S. PATENT DOCUMENTS

| | | | |
|---|---|---|---|
| 4,675,264 | 6/1987 | Kawamura et al. | 430/664 |
| 4,721,663 | 1/1988 | Johncock et al. | 430/65 |
| 5,139,911 | 8/1992 | Yagi et al. | 430/66 |
| 5,159,389 | 10/1992 | Minami et al. | 355/211 |
| 5,351,109 | 9/1994 | Haneda | 355/219 |
| 5,395,716 | 3/1995 | Schade et al. | 430/664 |

FOREIGN PATENT DOCUMENTS

| | | |
|---|---|---|
| 62-151858 | 7/1987 | Japan . |
| 63-240553 | 10/1988 | Japan . |

*Primary Examiner*—Joan H. Pendegrass
*Attorney, Agent, or Firm*—Loeb & Loeb LLP

[57] ABSTRACT

An electrophotographic apparatus using an a-Si photosensitive drum. The a-Si photosensitive drum has a thickness between 2 and 25 μm. The initial charging potential on the photosensitive drum is set to 450V or below. The center exposure wavelength of an exposure means is set to 700 nm or above. The photosensitive drum includes a photoconductive layer formed as a thin film a-Si layer having a temperature characteristic of 1.0 V/°C. or below. For realizing low charging potential and low electric field development, the thickness d of the photoconductive layer in the photosensitive drum is set to 2 to 24 μm, the relative dielectric constant εr is set to 2 or above, and the ratio d/εr is set to 9 or below. The photosensitive drum is formed on a conductive support and has a three-layer structure, including a carrier charge blocking layer for blocking the introduction of carrier charge (of the opposite polarity to that of charging) from the conductive support into the photoconductive layer, a photoconductive layer and an insulating or high resistivity layer.

18 Claims, 15 Drawing Sheets

FIG. 2(A)

RELATION BETWEEN PHOTOSESITIVITY FILM THICKNESS AND HALF SENSITIVITY

| 685nm | | 740nm | |
|---|---|---|---|
| THICKNESS (μm) | SENSITIVITY ( $cm^2/\mu j$ ) | THICKness (μm) | SENSITIVITY ( $cm^2/\mu j$ ) |
| 7 | 2.67 | 7 | 1.75 |
| 10 | 3.61 | 10 | 2.57 |
| 15 | 5.46 | 15 | 3.72 |
| 20 | 6.71 | 20 | 4.88 |
| 25 | 7.58 | 25 | 5.85 |
| 40 | 11.11 | 40 | 9.09 |

vo : 200(V)

FIG. 4

ELECTROPHOTOGRAPHIC APPARATUS HAVING AN A-SI PHOTOSENSITIVE DRUM ASSEMBLED THEREIN

BACKGROUND OF THE INVENTION

1. Field of the Invention

This invention relates to electrophotographic apparatuses such as printers, copiers, facsimile sets, etc. with an a-Si photosensitive drum assembled therein.

2. Description of the Prior Art

Electrophotographic apparatuses based on a commonly termed Carlson's process are well known in the art, in which individual process step means for exposure, development, transfer, cleaning (i.e., removal of residual toner), discharging and charging are disposed around the photosensitive drum outer periphery for image formation by a predetermined electrophotographic process.

Recently, a further electrophotographic apparatus is well known in the art, which comprises a photosensitive drum including a cylindrical transparent support and a transparent conductive layer and a photoconductive layer, these layers being laminated on the support, and exposure means (for instance an LED head) disposed in the drum for generating optical output corresponding to image information. The photosensitive drum is charged with predetermined charging means and then exposed to the optical output of the exposure means through a converging lens. Simultaneously with or right after this moment, a latent image that is formed on the photosensitive drum is developed via a developing sleeve facing therewith into a toner image, which is then transferred by a transfer roller or like transfer means onto recording sheet (the apparatus being disclosed in, for instance Japanese Patent Laid-open Publication No. Sho 58-153,957 and hereinafter referred to as internal exposure type electrophotographic apparatus).

Among the above various electrophotographic apparatuses, the one based on the Carlson's process usually utilizes, for uniform charging of the photosensitive drum surface, a corotoron system for wire application of a high voltage of 4 to 8 kV or above or corona discharge generated between a charging roller and the photosensitive drum by application of a charging bias to the charging roller.

In the Carlson system, the latent image is developed usually by an insulating magnetic brush development process. This means that 500 to 800 V or above is required as the development contrast potential on the photosensitive drum surface at the development position thereof (i.e., potential difference between dark and bright areas), thus dictating as high initial charging potential as 600 to 1,000V.

Meanwhile, recently apparatuses using a-Si photosensitive drums are being developed as the above individual electrophotographic apparatuses for providing for improved durability and free maintenance and rapidly expanding the market. However, the a-Si photosensitive material, compared to organic photoconductive material (OPC), has large relative dielectric constant $\epsilon r$ of 11 to 12. (With a Se or OPC photosensitive drum the relative dielectric constant $\epsilon r$ is 8 or below.) In addition, its dark resistivity $\rho d$ is comparatively low, i.e., $1\times10^{10}$ Ω·cm. (Wi th a Se or OPC photosensitive drum the dark resistivity $\rho d$ is $1\times10^{13}$ Ω·cm.)

Therefore, for the charging to as high potential as noted above, it has been necessary for the photosensitive drum to have a thickness of at least 30 μm.

Deposition of a-Si photosensitive material to a thickness of at least 30 μm, however, requires expensive vacuum equipment, thus posing serious problems both technically and economically. For example, a-Si photosensitive drum which is manufactured by a plasma CVD process, requires 10 times the cost of OPC photosensitive drum because of a long deposition time that is required.

Further, the large thickness deposition of the a-Si material has posed the following problems.

(1) The reduction of the photosensitive drum surface potential in non-exposed areas (i.e., dark areas) during a period from the charging till the development, is called dark attenuation. With the a-Si photosensitive drum the dark attenuation is as high as about 100V, making it necessary to take such dark attenuation into considerations and increase the initial charging potential correspondingly with respect to a required development potential. Since the a-Si photosensitive drum has a low breakdown voltage, in its long use or its use in high temperature, high relative humidity environments, the minute film formation defects present in the photosensitive layer are gradually expanded due to rupture, thus resulting in the appearance of black or white points in the recorded image as a cause of the image quality deterioration.

One cause of the dark attenuation is the generation of thermally excited carriers in the photosensitive layer. These thermally excited carriers are moved to the photosensitive drum surface to cause charge neutralization, thus bringing about the attenuation of the surface potential. The amount of thermally excited carriers that are generated is increased in proportion to the thickness of the photosensitive layer, and hence the dark attenuation is increased in proportion to the thickness of the layer. Particularly, with the a-Si photosensitive drum, because of narrow band gap of the a-Si material and also of high localized level density in the band gap as centers of thermally excited carrier generation, the amount of thermally excited carriers that are generated is large, and the increase of the dark attenuation due to thickness increase is greater compared to other photosensitive materials.

(2) For electrophotographic color image recording, it is desired that the high sensitivity panchromation of the photosensitive drum, i.e., the photosensitivity thereof to different exposure wavelengths, is substantially uniform. Generally, a photosensitive layer readily absorbs and has low light transmittivity to short wavelength light. With a thick photosensitive layer, the light absorption takes place only on an exposure side part of the photosensitive layer, thus generating photocarriers. For this reason, the photosensitivity to short wavelength light tends to be reduced. On the other hand, the photosensitive layer readily transmits long wavelength light, thus generating photocarriers substantially over the entire area of the photosensitive layer even where the thickness thereof is large. This means that the photosensitivity to long wavelength light tends to be increased. However, where the energy of the long wavelength light is less than the optical band gap of the photosensitive layer, light absorption no longer takes place therein, thus resulting in sharp sensitivity reduction.

Such photosensitivity difference with the wavelength is increased with a-Si photosensitive drum thickness. The panchromation is thus deteriorated, so that the apparatus is no longer suited to the color image recording.

(3) Increasing the thickness of the a-Si photosensitive drum increases the running distance of photocarriers to deteriorate the photosensitivity, thus posing a problem that the photosensitivity of the photosensitive drum is insufficient. Also, increasing the recording process side speed leads to insufficiency of the process side exposure. In this case, sufficient developing contrast potential can not be formed, thus resulting in insufficient image density or the like. In consequence, it is difficult to use an exposure light source, which provides low light dose although its cost reduction is expected. For instance, it is difficult to use a LED head using a LED array which is formed through epitaxial growth of a gallium-arsenic-phosphorus (GaAsP) type III-V group element compound semiconductor on a Si single crystal substrate. Likewise, it is difficult to use an EL head using an EL element array.

An a-Si drum has photosensitivity which is strongly wavelength dependent. Particularly, where a long wavelength of 700 nm or above is used as exposure wavelength, it is inevitable that photocarriers are trapped, thus resulting in residual image generation due to drum memory potential increase.

To prevent the residual image as much as possible, the discharging step is carried out by illumination with more erasing light dose than is necessary. Doing so, however, may not always ensure perfect elimination of residual image. Rather, it causes deterioration of the image quality.

Therefore, heretofore the exposure wavelength has been limited to 700 nm or below to prevent the residual image generation. However, particularly in an electrophotographic printer the exposure wavelength of the LED used as the exposure means is 660 to 710 nm, that is, it may be 700 nm or below. On the other hand, in a semiconductor laser the exposure wavelength is a long one, i.e., 760 to 830 nm. This means that where an a-Si drum is used, it has been difficult to perfectly prevent the residual image generation.

The LED arrays use LED which is formed by using a gallium-arsenic-phosphorus (GaAsP) semiconductor. In thistype of LED, for making the wavelength to be shorter toward the center wavelength side, particularly the proportion of phosphorus (P) has to be increased in the film formation on wafer. This means that the film formation requires an increased time of 1 to 1.5 days, thus increasing the cost of manufacture.

Besides, the increase of the film formation time leads to generation of corresponding manufacturing fluctuations. Particularly, in many LED chips with center wavelengths around 660 nm, brightness fluctuations exceeding 20% have been the case.

(4) The increase of the photocarrier running distance leads to ready dispersion of photocarriers in the film surface direction, thus resulting in blurred boundaries of electrostatic latent image and in unsufficient reduction of image forming on photosensitive drum surface corresponding to exposure.

As an example, in a laser printer using a semiconductor laser as exposure source, the oscillation wavelength from the semiconductor laser is beam scanned with a polygon mirror via a collimator lens and then focused on a photosensitive drum via a Fθ lens. This means that in the laser printer it is necessary to accurately focus strip-like light having been expanded to the neighborhood of A-4 size with the polygon mirror. Therefore, the Fθ lens has to have a length corresponding to the A-4 size. It is considerably difficult to assemble such a lens accurately, and assembling and machining errors and thermal expansion are liable.

Such errors and long lens structure cause generation of optical aberration or focal deviation on the photosensitive drum. A thick a-Si drum as noted above picks up light dose corresponding to the aberration, thus making it difficult to increase the contrast or sharpness of image.

Further, in the above laser printer it is intended to reduce the focal distance for size reduction. However, it is necessary to permit accurate focusing strip-like light having been expanded up to the neighborhood of A-4 size with the polygon mirror. Therefore, the Fθ lens requires a length corresponding to the A-4 size and various contrivances such as, for instance, the provision of a thoric shape as its curved surface.

Such a lens which is long and has a complicated shape, is suitably a plastic lens. Where a plastic lens or like lens having a low refractive index is used, however, its opposite end focusing parts may not always be straight in accord with the photosensitive drum bus bar, and design contrivances are necessary for forming a high quality image having a unifom width in the main scanning direction.

This is applied to LED printers and copiers as well. Usually, a Selfoc lens (a trade name) is used to focus the exposure image. The Selfoc lens comprises many fibers having arranged lengths and made integral. Therefore, where a plastic lens or like lens having a low refractive index is used, focusing errors are liable to be generated due to the long focal distance. These errors cause aberration, which is picked up to result in the sharpness reduction again, thus making it impossible to form high quality, high contrast dot images.

(5) Further, the a-Si photosensitive drum includes a photosensitive layer which is deposited by the plasma CVD process at as high substrate temperature as about 270° C. This means that the deformation of the Al support drum after the film formation is great compared to other photosensitive materials. To suppress this deformation, the Al support usually should have a thickness of 3 to 8 mm, thus leading to high material cost of the support compared to the OPC photosensitive drum, the thickness of which need be 0.7 to 1.2 mm. Further, for polishing the Al support drum surface it is possible to use only a mechanical machining process using a lathe, and it is impossible to use a polishing process, which is based on extrusion formation and requires low machining cost.

(6) Where the corona discharge is utilized for charging the photosensitive drum, ozone is generated as well as oxides of nitrogen and ammonium salt as products of discharge, these compounds being attractively attached to the photosensitive drum surface for readier generation of image flow.

With an OPC drum or like soft drum, the above generation of oxides of nitrogen does not lead to a substantial problem, because the drum surface is scraped off slightly through the firction thereof with a cleaning blade for removing residual toner remaining after the transfer. With an a-Si drum, however, the generation of oxides of nitrogen is a problem because the drum is hard.

Therefore, with the a-Si photosensitive drum the surface thereof is polished with a polishing blade or a polishing roller to remove the products of discharge so as to prevent the generation of image flow.

Further, a-Si can highly absorb water compared to OPC and other organic semiconductors. Therefore, the a-Si drum is more frequently prone to the image flow.

Accordingly, in the prior art using the a-Si photosensitive drum, a sheet heater or like heater is disposed on the back side of the photosensitive drum to heat the drum so as to maintain the drum surface temperature to be constant, thus preventing the generation of fog or the like that may otherwise result from drum surface temperature changes.

The internal provision of the heater, however, while increasing the power consumption, requires a heater, thermistor for detecting the drum surface temperature, and a control circuit for controlling the heater according to the temperature detected by the thermistor, etc., thus increasing the number of components and complicating the circuit structure.

Besides, where the heater is used, it is necessary to wait until the heating of the drum surface to a predetermined temperature, that is, a warm-up time of about 90 seconds is necessary.

SUMMARY OF THE INVENTION (Objects)

An object of the invention is to provide an electrophotographic apparatus of Carlson type or internal exposure type using an a-Si photosensitive drum, which permits stable image formation for long time.

Another object of the invention is to provide an image formation apparatus, which makes use of satisfactory electrophotographic characteristics of a-Si photosensitive drum and can eliminate dark attenuation increase or photosensitivity reduction or resolution reduction in the electrophotographic apparatus of either of the above types using the a-Si photosensitive drum.

A further object of the invention is to provide an electrophotographic apparatus of either of the above types using the a-Si photosensitive drum, in which the thickness of an Al support is reduced by reducing the deformation thereof, thus reducing the cost of material and machining with respect to the support used and the film formation process.

A still further object of the invention is to provide an electrophotographic apparatus, which permits sharp image formation with considerations of the simplification of the structure and the safety and without generation of fog or immage flow with ambient temperature changes even in the electrophotographic apparatus of either of the above typesusing the a-Si photosensitive drum.

An yet further object of the invention is to provide an electrophotographic apparatus, which permits ready formation of image free from residual image formation by using exposure means of a long wavelength of 700 nm or above even in the electrophotographic apparatus of either of the above types using the a-Si photosensitive drum.

A still another object of the invention is to provide an electrophotographic apparatus, which permits high durability to be obtained by using an a-Si photosensitive drum and also permits high contrast, high quality image to be formed even with generation of focusing aberrations or focus errors even in the electrophotographic apparatus of either of the above types.

An yet another object of the invention is to provide a Carlson type electrophotographic apparatus, in which an a-Si drum used as photosensitive drum is charged uniformly with a corona discharge device or a charging roller or charging brush providing a discharge phenomenon, and which permits formation of sharp image without generation of image flow or fog.

(Constitutions)

A feature of the invention resides in an electrophotographic apparatus of Carlson type or internal exposure type using an A-Si photosensitive drum, in which the total thickness of the a-Si photosensitive drum excluding a surface layer is set to substantially 2 to 25 μm, preferably 2 to 20 μm, more preferably 2 to 15 μm.

In this case, to permit a low charging potential and low electric field development to be obtained as will be described later, it is suitable to set the thickness d of a photoconductive layer in the photosensitive drum to 2 to 24 μm while setting the relative dielectric constant $\epsilon r$ of the photoconductive layer to 2 or above and ($d/\epsilon r$) to 9 or below.

Further, it is suitable to form the photosensitive drum on a conductive support such as to have a three-layer structure comprising a carrier charge blocking layer for blocking the introduction of carrier charge (of the opposite polarity to the charging of the photosensitive drum) from the conductive support into the photoconductive layer, the photoconductive layer and a surface Layer constituted by an insulating or high resistivity layer and set the thickness of the photoconductive layer to 2 to 24 μm.

Where the conductive support is a cylindrical aluminum substrate, it is suitable to set the thickness of the support to 3 mm or below.

Where the carrier charge blocking layer is a heavily doped P-type semiconductor layer, it is suitable to form the photoconductive layer as an I- or N-type semiconductor layer or by laminating I- and N-type semiconductor layers.

Conversely, where the carrier charge blocking layer is a heavily doped N-type semiconductor layer, it is suitable to form the photoconductive layer as an I- or P-type semiconductor layer or by laminating I- and N-typesemiconductor layers.

In this case, in developing means for forming image on the photosensitive drum, suitably a conductive magnetic brush is formed with a developer constituted by a combination of a conductive magnetic carrier and an insulating toner or by a single component conductive magnetic toner such that the development contrast potential between exposed and non-exposed areas of the photosensitive drum surface in contact with the magnetic brush (i.e., potential difference between dark and bright areas) is set to be in a range of 10 to 360 V, preferably 10 to 240 V.

Further, the charging means is suitably one which effects low potential charging. Specifically, the surface potential on the photosensitive drum right after the charging thereof by the charging means (i.e., initial charging potential) is suitably set to substantially 450V or below, preferably substantially 350V or below, more preferably substantially 300 V or below.

Further, by forming the photoconductive layer in the photosensitive drum as a thin film a-Si layer with a temperature characteristic of 1.0 (V/°C.) or below, it is possible to obtain image formation without provision of any heater in the support supporting the photosensitive layer but at the ambient temperature in the apparatus.

Further, in the exposure means it is suitable to set the center exposure wavelength to 700 nm or above.

Particularly, in a printer, a facsimile or the like of Carlson type where inverse development is done for image formation, suitably the photosensitive drum except for the surface layer is formed with an a-Si photosensitive material having a thickness of substantially 2 to 25 μm, while setting the initial charging potential on the photosensitive drum to substantially 450V or below and the center exposure wavelength of the exposure means to 700 nm or above. Further, forming the photoconductive layer in the photosensitive drum as a thin film a-Si layer with a temperature characteristic of 1.0 (V/°C.) below is suitable in that doing so permits image formation without provision of any heater in the support but at the ambient temperaturein the apparatus.

Further, according to the invention by forming the photoconductive layer in the photosensitive drum as an a-Si layer having a thickness of 2 to 24 μm and setting the half sensitivity of the photosensitive drum in a range of 8 to 1

$cm^2/\mu J$ that is necessary for the reduction of the exposure potential by the exposure means to one half the surface potential on the photocoductive layer, it is possible to construct the focusing lens assembled in the exposure means as a plastic lens with a refractive index of 1.51 or below.

Further, the fact that low charging development is possible with the formation of an a-Si layer having a thickness of 2 to 24 μm as the photoconductive layer in the photosensitive drum, means that the charging roller or the corotoron system may not always be used for the charging means. For example, it is possible to use particle charging means for uniformly charging the photosensitive drum. In this case, to permit charging with a further low charging bias, the particle charging means is suitably arranged such that charging particles on the photosensitive drum are capable of friction relative thereto while being relatively moved.

Suitably, the particle charging means is arranged such that the support is formed with a non-magnetic material and that a pair of opposite polarity magnetic poles are disposed on the back side of the support at a position thereof corresponding to the area of friction of the charging particles to set up a horizontal magnetic field for having the particles to be able to undergo friction over the photosensitive drum in close contact therewith. Further, a DC bias is set suitably to 600 V or below as a charging bias to be applied to by the particle charging means.

(Functions)

The invention will be described in greater detail.

In the first place, the laminar structure of the a-Si photosensitive drum and functions thereof at the time of charging and development will be described.

FIG. 1(A) is a sectional view showing the laminar structure of a positive charging a-Si photosensitive drum 1. As shown, a carrier charge blocking layer 1*a* of, for instance, heavily doped P-type a-Si, a photoconductive layer 1*b* of, for instance, I-type or lightly doped N-type a-Si, and a surface layer 1*c* of, for instance, an a-Si type high resistivity material, e.g., a-SiC, a-SiN, etc. are laminated in the mentioned order on a photoconductive support 11 of Al or the like.

When this a-Si photosensitive drum 1 is charged by high potential positive charging as in the prior art, the carrier charge blocking layer 1*a* which is heavily doped to P-type and has a thickness of about 1 to 5 μm, is free from formation of any depletion layer as a layer part with majority carriers forced out therefrom by the electric field in the jnction with the photoconductive layer 1*b*. That is, the whole layer maintains the character of a semiconductor layer, and it is not regarded to be an insulating layer. On the other hand, in the photoconductive layer 1*b* which is an I-type or lightly doped N-type layer, a depletion layer $1b_2$ is formed because of a low carrier density compared to the carrier charge blocking layer 1*a*. The photoconductive layer 1*b* in this case is considered separately for the depletion layer $1b_2$ as a layer part which has so high resistivity that it may be regarded to be an insulating layer and a layer part $1b_1$ which maintains the character of semiconductor layer.

Meanwhile, when making low potential development with an initial charging potential of 450 V or below with respect to a prior art thick photosensitive drum having a thickness of 40 μm or above, because of a low charging potential across the photosensitive layer, the electric field in the junction between the carrier charge blocking layer 1*a* and photoconductive layer 1*b* is low, and the layer part with the majority carriers forced out therefrom is so small that width of the depletion layer $1b_2$ can be ignored. More specifically, a thin depletion layer $1b_2$ is formed in photoconductive layer 1*b* having a thickness of 40 μm or above, its thickness is at most 0.1 to 2 μm, and in the above thick photoconductive layer 1*b*, the high resistivity depletion layer $1b_2$ which is regarded to be substantially an insulating layer provides very low contribution to the breakdown voltage and charging.

In contrast, where the total thickness of the photosensitive drum except for the surface layer is 25 μm or below as according to the invention, even when the charging potential is reduced by using low potential charging development at 450V or below, preferably 350V or below, the proportion of the depletion layer $1b_2$ in the photoconductive layer 1*b* is so large, that is, the former layer $1b_2$ occupies a major portion of the latter layer 1*b*. The photosensitive layer thus has an increased apparent resistivity to increase the charging and breakdown voltage in the neighborhood of the thickness of the photosensitive layer, thus permitting sufficient image density to be obtained.

Further, setting the total thickness of the photosensitive drum except for the surface layer to 25 μm or below provides for satisfactory influence on the exposure.

The inventor has found that the half sensitivity of the photosensitive drum, particularly a-Si one, depends on the thickness thereof, and particularly that by setting the thickness thereof to be 25 μm or below and the half sensitivity of the photosensitive drum that is necessary for the reduction of the exposure potential to one half the surface potential across the photosensitive layer to be in a range of 8 to 1 $cm^2/\mu J$, it is possible that light dose of aberration due to focus errors or like cause is not picked up but only the center light dose is picked up to permit formation of high quality dot image having high image contrast or sharpness.

As noted before, to pick up only the center wavelength even in case of the generation of focus aberration, has an effect of increasing the depth of focus. Thus, even when focus aberration is generated at the opposite ends of a Fθ lens or like lens having a large width, a high quality image having a uniform width in the main scanning direction may be formed without picking up such aberration.

This means that when a focus error of about ±300 μm is generated with the use of a "Selfoc lens" (a trade name) or like lens such as a plastic lens with a low refractive index in an LED printer or copier, such an error can be readily absorbed to form high quality, high contrast dot image.

Thus, according to the invention high quality image formation is possible with a plastic lens having a refractive index of 1.51 or below used as the optical Lens for focusing the exposure image. Besides, in this case the assembling and machining errors are permissible. It is thus possible to greatly reduce the cost of manufacture.

The above considerations will now be described in detail with reference to FIGS. 4 to 8. These graphs will be described in conjunction with an embodiment to be described later in detail.

FIG. 4 is a table relating the thickness of a-Si photosensitive drum and the half sensitivity thereof, and FIG. 5 is a graph showing this relation. It will be seen that with an exposure wavelength of either 740 nm or 685 nm the half sensitivity of the a-Si photosensitive drum is reduced in proportion to the thickness of the photosensitive drum.

FIGS. 6(A) and 6(B) show the relation between vertical and horizontal line widths and dot number with an excposure wavelength of 740 μm for certain potosensitive drum film thickness. As is seen from the Figure, with a thickness of 25 μm, compared to a thickness of 40 μm, the line width is sharpened to provide for great image quality improvement. With thickness less than 25 μm, on the other hand, the line width sharpness was substantially in accord, and there was no effective difference.

As is seen from FIG. 4, in case of a thickness of 25 μm the half sensitivity is 7.58 $cm^2/\mu J$ and 5.85 $cm^2/\mu J$ with respective exposure wavelengths of 685 nm and 740 nm, and in case of a thickness of 40 μm it is 11.11 and 9.09 $cm^2/\mu J$ with respective exposure wavelengths of 685 nm and 740 nm. It will be seen from these empirical results that it is possible to form image of high sharpness as shown in FIG. 6 by setting the half sensitivity of the photosensitive drum to 8 $cm^2/\mu J$ or below.

Excessive reduction of the half sensitivity, however, results in blur of the line image. Since sufficient sharpness can be ensured with a half sensitivity of 1.75 $cm^2/\mu J$ with an exposure wavelength of 740 nm in case of a thickness of 7 μm as is seen from the table of FIG. 4, it will be seen that no problem arises with a half sensitivity of 1 $cm^2/\mu J$ or above.

FIG. 7 shows shows the relation between the depth of focus and drum sensitivity. Reduction of the drum sensitivity results in increase of the depth of focus because aberrations around the position of focus are not picked up. However, the depth of focus which is around 150 to 230 μm in case of a thickness of 40 μm, is greatly improved to around 380 μm, and substantially the same result is obtainable with a thickness reduced to 7 μm.

Thus, an increase of the depth of focus permits more roughly setting the machining and assembling accuracies of the optical system for focusing exposure image on photosensitive drum, greatly reduces image quality fluctuations and further permits use of a plastic lens as described before.

This can be understood from the fact that, as shown in FIG. 8, with a thickness of 25 μm or below the MET value is substantially the same irrespective of whether the lens used is a plastic lens or an optical glass lens, but with a thickness of 40 μm the MET value is greatly reduced where a plastic lens is used.

FIG. 9(A) is a graph showing the relation between the exposure potential and thickness of the photosensitive drum. As is seen from the Figure, in case of focusing exposure image with an exposure wavelength of 685 nm on the photosensitive drum, with a thickness of 40 to 25 μm the exposure potential is substantially at the residual image realization level, but with the thickness reduction it is reduced proportionally from the residual image realization level.

On the other hand, in case of focusing exposure image with an exposure wavelength of 740 nm on the photosensitive drum, with a thickness of 40 μm, the exposure potential is high compared to the case with an exposure wavelength of 685 nm and is higher than the residual image realization level, but with the thickness reduction from the value of 25 μm it is reduced proportionally to be lower than the residual image realization level with a thickness of around 15 μm.

FIG. 9(B) shows the relation between the memory potential and exposure wavelength with certain thicknesses of the photosensitive drum. It will be seen that by setting the total thickness of the photosensitive drum except for a surface layer thereof to 25 μm or below, preferably 20 μm or below, more preferably 15 μm, it is possible to maintain the memory potential to be lower than or in the neighborhood of the residual image realization level even with a set exposure wavelength of 700 nm or above.

In this case, however, with the thickness reduction of the photosensitive layer, as described before, excessively increasing the charging potential applied across the photosensitive layer leads to a possibility of electrical rupture of the film produced, and for this reason the photosensitive layer is suitably charged such that the surface potential thereacross is 450V or below, preferably 360 V or below.

Further, it is seen from FIG. 6 that in case of an exposure wavelength of 740 nm, the resolution and sharpness of image are greatly improved with a thickness of 25 μm or below compared to those with a thickness of 40 μm.

Thus, according to the invention there is no possibility of residual image generation by carrying out exposure with a semiconductor laser with an exposure laser wavelength of 700 nm or above.

Further, in case of using LED for the exposure means, the possibility of setting the LED light emission wavelength of 700 nm or above is very advantageous in view of the LED manufacture.

More specifically, the fact that the light emission wavelength may be 700 nm means that it is possible to obtain GaAsP film formation on wafer by reducing the proportion of phosphorus (P). This means that when manufacturing LED with a wavelength of 740 nm, compared to the case with a wavelength of 680 nm, the film formation time can be greatly reduced to 7.5 hours, thus greatly reducing not only the cost of manufacture but also fluctuations therein.

Further, as shown in FIG. 4, by reducing the thickness to 25 μm or below and using a long wavelength of 700 nm or above for exposure, the half sensitivity is greatly reduced to about one half to one third in comparison to the case of exposure with a short wavelength of 700 nm or below by using the prior art a-Si drum having a thickness of 40 μm. It is thus possible to improve the exposure resolution and increase the depth of focus in view of the image quality.

The increase of the depth of focus provides for satisfactory effects from the standpoint of the image flow.

Now, the causes of the image flow will be described.

As the system for development in an electrophotographic apparatus, there are a positive development system and an inverse development system. In the positive development system, as in a development system used for a copier or the like, a magnetic toner is charged to the opposite polarity to the photosensitive drum surface potential, and after exposing the photosensitive drum having been uniformly charged, the magnetic toner having been charged to the opposite polarity is attached to latent image areas which have not been exposed. In the inverse development system, as in a development system used for a printer, a magnetic toner is charged to the same polarity as that of the photosensitive drum surface potential, and after exposing the photosensitive drum having been uniformly charged to image to form a latent image with charge removal, the magnetic toner having been charged to the same polarity is attached to the latent image by utilizing a development bias.

Particularly in the inverse development system, asshown in FIG. 10(A), the photosensitive drum is charged uniformly to a predetermined surface potential $V_O$ before the exposure. As a result, an inverse normal latent image potential distribution is formed, and the toner is attached to portions of the distribution with the potential reduced form a threshold level $V_B$.

That is, in the inverse development the toner dot diameter D is determined by the threshold level $V_B$.

Meanwhile, in the a-Si photosensitive drum, a phenomenon of dischage that is caused to charge the drum causes generation of ozone and attachment of discharge products to the drum surface to increase the moisture absorption property thereof, thus reducing the drum surface resistance and surface potential $V_O'$ in a high relative humidity situation.

Since the toner dot diameter D is determined by the threshold level $V_B$ as noted above, with the reduction of the surface potential $V_O'$ the corresponding dot diameter D' of the latent image potential distribution is increased. Therefor, burred image, i.e., image flow, is liable.

To prevent the image flow, it is necessary to reduce the surface potential reduction ($V_O$-$V_O'$) due to the moisture absorption property and also to sharpen the latent image potential distribution so as to prevent dot diameter increase when the surface potential $V_O'$ is reduced.

Meanwhile, as is understood from FIGS. 6(A) and 6(B) showing the relationship between the line width and drum film thickness, when the drum film thickness is 40 μm or below, the line width is large compared to that when the thickness is 25 μm or below, with corresponding reduction of the sharpness and resolution. When the thickness is 25 μm or below, the sharpness and resolution are substantially in accord, and there is no effective difference.

Further, as is seen from FIG. 7, in cases of thicknesses of 7 and 15 μm the depth of focus is improved to be 370 μm, which is almost double the depth of focus in case of a thickness of 40 μm. The increase of the depth of focus indicates that it is possible to maintain sharpness even when the surface potential $V_O'$ is reduced.

For example, as shown in FIG. 10(B), by setting the thickness of the photosensitive drum to 25 μm or below, preferably 20 μm or below, more preferably 15 μm or below, it is possible to sharpen the latent image potential distribution so as to reduce the toner dot diameter D that is determined by the threshold level $V_B$ and also reduce variations of the dot diameter D with reduction of the surface potential $V_O'$, thus reducing bur.

Thus, with a photosensitive drum of a-Si material it is possible by reducing the thickness thereof to obtain the predetermined surface potential $V_O'$ even with reduced optical output. In this case, the lower limit of the thickness is suitably set to substantially 2 μm.

This is so in view of the fact that where a-Si:H material, for in stance, is used for LED or like exposure means with a wavelength of around 700 nm, the thickness until absorption of 90% of incident light is about 2.2 μm.

Further, the reduction ($V_O$-$V_O'$) of the surface potential with ambient temperature changes may be reduced by reducing the charging surface potential $V_O$ itself. Besides, it has been found that, as is seen from FIG. 5, with reduction of the drum film thickness the variations of the surface potential $V_O'$ with temperature changes are reduced. By way of example, with a photosensitive drum having a thickness of 40 μm, the potential change with a temperature change from 10° to 40° C. is 80 V (2.7 V/°C.), whereas with drums having thicknesses of 25 and 15 μm, owing to great reduction of the temperature dependency, it is 30 V (1.0 V/°C.) and 15 V (0.5 V/°C.), respectively.

With an a-Si photosensitive drum, its thickness resistance is 20 V/μm or below, usually 12 to 15V/μm. Thus, where its thickness is set to 25 μm or below, by setting the initial charging potential to 450 V, preferably substantially 360 V or below, it is possible to prevent burring of image and also thickness deterioration in long use.

Usually, copiers or printers are provided in environments in which personnel can work comfortably, such as offices air conditioned to provide cooling in summer and heating in winter. Thus, in the office the temperature variations are not so much as those outdoors, and the temperature difference in the morning when the cooling or heating is not sufficient is at most around 30° C.

Thus, it can be understood that when the initial charging potential on the photosensitive drum is set to at least substantially 450 to 360 V or below, preferably substantially 300V or below, it is possible to use the drum without any drum heater so long as the thickness is 25 μm or below because the tolerance of fog in long use is ±25V.

Thus, according to the invention it is possible to form image free from fog or the like without use of any heater. Power consumption thus can be greatly reduced. In addition, it is possible to reduce electric components such as heater, drum surface temperature detection thermistor, heater control circuit based on the temperature detected by the thermistor, etc. and simplify the circuit construction. Further, since no heater is used, no warming-up time is necessary, and thus it is possible to greatly reduce the rising time of the apparatus.

Further, according to the invention the effects described above are promoted by setting the exposure wavelength to 700 nm or above.

Further, the particle charging means, in which charging particles can be moved relative to the photosensitive drum for friction therewith, effects charging through charge introduction with the particles in close contact with the drum. Besides, smooth charging is obtainable with a low DC charging bias voltage, for instance of 500 V or below. This means that with the setting of a low DC bias there is no possibility of ozone generation or generation of discharge products.

Further, according to the invention the use of the particle charging means, in which charting particles are capable of friction with the photosensitive drum with a relative speed provided with respect to the drum, has such an effect that water that may be absorbed by the drum can be removed by the friction noted above, thus further ensuring the image flow prevention effect.

Particularly, the effect is promoted with such an arrangement that a horizontal magnetic field holds the particles in close contact with the drum while in friction therewith.

Further, by using as the surface layer an a-SiC layer of an inorganic high resistivity or insulating material, it is possible to promote the moisture resistance and obtain more satisfactory effects.

BRIEF DESCRIPTION OF THE DRAWINGS

FIGS. 4 and 5 showing the relation between the half sensitivity and thickness of drum, FIG. 4 being a table, FIG. 5 being a graph;

DETAILED DESCRIPTION OF THE PREFERRED EMBODIMENT

Now, an embodiment of the invention will now be described in detail with reference to the drawings. The dimensions, materials, shapes, relative dispositions, etc. of the component parts described in this embodiment, unless otherwise specified, are not intended to limit the scope of the invention but are merely exemplary.

Figure 2:
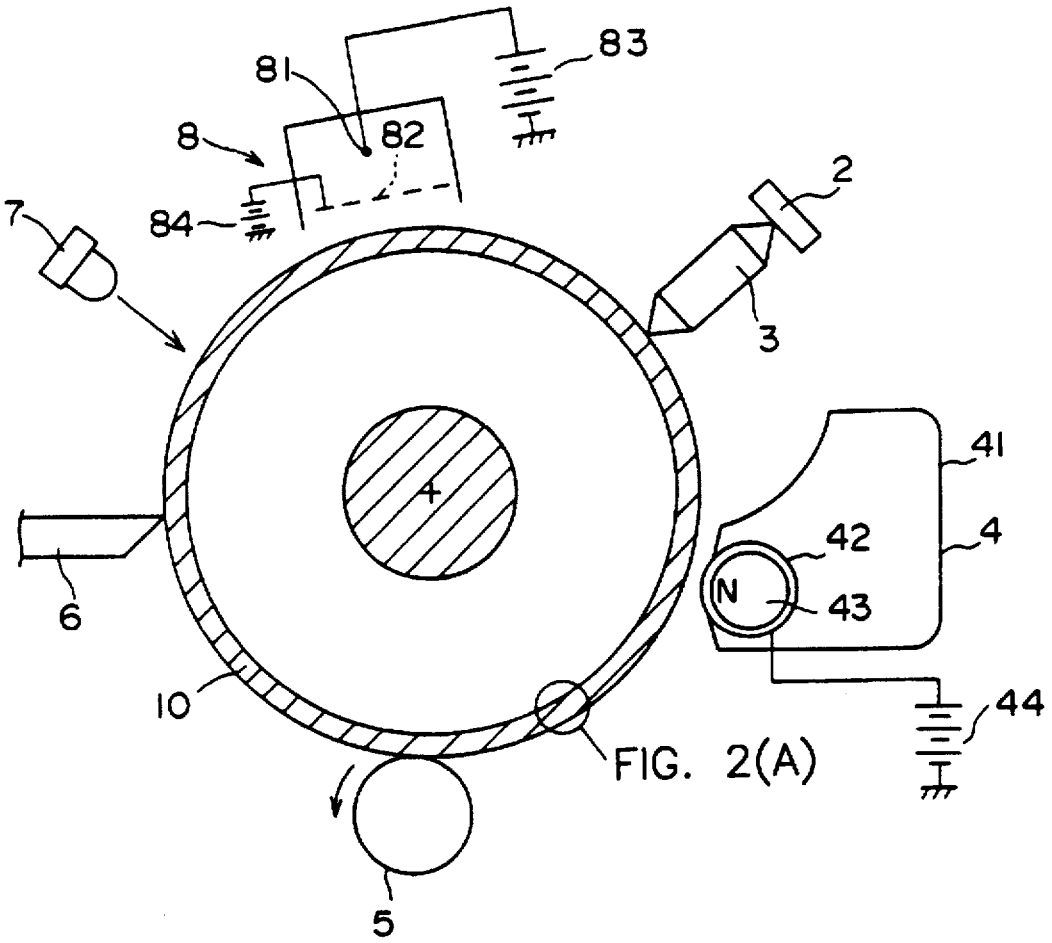
FIGS. 2 and 2A are schematic views showing an electrophotographic apparatus with corotoron charging means in an embodiment of the invention.

FIG. 2 is a schematic view showing a Carlson type electrophotographic apparatus according to the invention. As shown, the apparatus comprises an a-Si photosensitive drum 10 capable of rotation in the clockwise direction in the Figure. Disposed around the drum 10 in the rotating direction thereof are an optical system including an exposure head 2 and a "Selfoc lens" 3, a two-component developing unit 4, transfer means 5, a cleaner 6, an eraser 7, and a charging unit 8. The charging means 8 may be one based on a contact charging process, for instance one in which a charging roller such as a conductive rubber roller is in contact, or a particle charging unit or the like, in which a conductive brush or a conductive magnetic brush formed by conductive magnetic particles is in contact as charging brush. In either case, the charging may be made by low potential charging, thus permitting voltage reduction in the charging power supply. Further, a corona charging unit may be used. In this case, because of low charging potential it is possible to reduce the width of the shield case discharge opening, thus permitting size reduction. From the standpoint of suppressing ozone generation, it is suitable to use the contact charging process. The polarity of charging may be positive or negative and is suitably selected in dependence on the characteristics of the photosensitive drum. As the exposure head, a LED head is used in this embodiment, but it is possible to use a laser, a liquid crystal shutter array, an EL Head, a phosphor dot array head, a plasma imaging bar, etc. as well. In the case of a copier, a halogen lamp or like light source is used, and reflected light from an original is projected in the form of a slit on the drum surface by an optical system including lenses, mirrors, etc. As the transfer means 5 a conductive rubber roller is used for transfer in this embodiment, but it is possible to use a corona charging unit as well. The polarity of transfer may be positive or negative, but usually it is opposite to the polarity of charging. As the cleaner 6 a rubber blade is used in this embodiment, but it is possible to use a rubber roller or a brush roller or a combination of these rollers as well. As the eraser 7 serving as discharging means, a LED array is used for light irradiation in this embodiment. However, it is possible to use a fluorescent lamp, a halogen lamp, an EL array or other light source as well. Further, it is possible to use such electric discharging process as AC corona discharge, AC voltage application, etc. With the above structure of the apparatus, toner image is formed on the photosensitive drum surface through the processes of charging, exposure and development, then transferred by the transferring means onto a transfer medium and then fixed by fixing means (not shown) to obtain a record image. Meanwhile, after the transfer the residual toner is removed by the cleaner 6 from the drum surface, and the surface potential thereon is then erased by the eraser 7. Then, the next image formation process is executed for image formation.

Now, the individual components of the apparatus will be described.

Figure 1A:
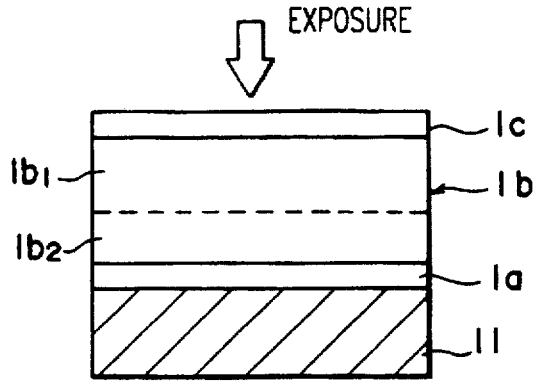
FIGS. 1(A) to 1(C) show laminar structure examples of photosensitive drum embodying the invention, FIGS. 1(A) and 1(B) showing laminar structures of photosensitive drum in Carlson type electrophotographic apparatus, FIG. 1(C) showing a laminar structure of photosensitive drum in internal exposure type electrophotographic apparatus.
Figure 2A:
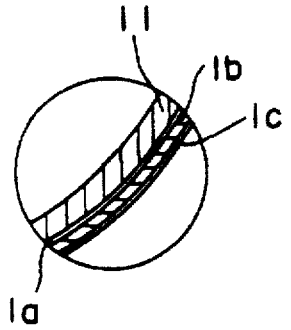

The photosensitive drum 10, as shown in a circular enlarged-scale view in FIG. 2A and in FIG. 1(A), comprises a conductive support 11 and a drum film 1 formed thereon as a lamination of a carrier charge blocking layer 1*a*, a photoconductive layer 1*b* and a surface layer 1*c*. The support 11 is usually a cylindrical member made of aluminum. As will be described later, the aluminum cylindrical member is made of an inorganic material such as glass or a transparent resin such as epoxy with the surface thereof covered by a conductive film 1*e*. In this embodiment, its thickness is set to 1.5 to 4 mm, its outer diameter is set to 30 mm, and its length is set to 300 mm. The drum film 1 particularly uses a-Si photosensitive material. The a-Si photosensitive material is formed by a glow discharge decomposition process (plasma CVD process) or, for instance, a reactive spattering process, an ECR microwave CVD process, an optical CVD process, a catalytic CVD process, a reactive deposition process, etc. In its formation, 1 to 40 atomic % of hydrogen (H) or a halogen element is introduced for the purpose of dangling bond termination. In order to obtain desired electric properties, such as dark conductivity or photoconductivity, and optical properties, such as optical band gap, of the drum film 1, it is suitable to introduce elements in Group IIIa in the periodic table of elements (hereinafter referred to as Group IIIa elements) or elements in Group Va in the periodic table of elements (hereinafter referred to as Group Va elements) or introduce carbon (C), nitrogen (N), oxygen (O), germanium (Ge), etc. Particularly, in case of using amorphous silicon carbide (hereinafter referred to as a-SiC) for the photocoductive layer 1*b*, the X value of $Si_{1-x}C_x$ is suitably set to $0<X\leqq 0.5$, suitably $0.05\leqq X\leqq 0.45$. To do so is desirable in that in this range the resistivity is higher than that of the a-Si layer, thus permitting satisfactory carrier running to be ensured. As the Group IIIa and Va elements, boron (B) and phosphorus (P) are desirable in that these elements are excellent in the covalent bond property and can subtly change semiconductor properties and, what is more, they permit excellent photosensitivity to be obtained.

Non-doped a-Si which does not contain any Group IIIa or Va element, is an weakly N-type semiconductor, and it is suitable to add a slight amount of a Group IIIa element to produce an I-type semiconductor or add an increased amount of the element to produce a P-type. Further, it is suitable to add a Group Va element to produce an N-type semiconductor. Further, the photoconductive layer may not only be of a laminar structure having a single conductivity type, but also it may be obtained by laminating I- and N-type layers or I- and P-type layers in dependence on the polarity of charging of the photosensitive drum. By so doing, it is possible to increase the spread of the depletion layer that is formed with respect to the carrier charge blocking layer 1*a*, thus permitting a photosensitive material suitable for low potential development to be obtained. The a-Si type photoconductive layer 1 according to the invention, desirably has a thickness of 0.5 to 24 μm, preferably 2 to 19 μm, more preferably 2 to 15 μm. The carrier charge blocking layer 1*a* is providedbetween the conductive support 11 and the photoconductive layer 1*b*. The carrier charge blocking layer 1*a* may be either an a-Si layer or an a-SiC layer, and suitably contains oxygen (O), nitrogen (N) or like element for improvind the close contactness with respect to the conductive support 11. Further, where the carrier charge blocking layer 1*a* and photoconductive layer 1 are both formed as a-SiC layers, suitably their C content is set to be high compared to the photoconductive layer 1*b*. The carrier charge blocking layer 1*a* contains an impurity element to prevent introduction of carriers (of the opposite polarity to that of the drum charging) from the conductive support 11 into the photoconductive layer 1*b*. To prevent introduction of negatively charged carriers, the layer suitably contains 1 to 10,000 ppm, preferably 50 to 5,000 ppm, of a Group IIIa element. On the other hand, to prevent introduction of positively charged carriers, it suitably contains 5000 ppm or below, preferably 50 to 3,000 ppm, of a Group Va element. These elements may be provided such that their distribution has a slope in the thickness direction of the layer. This may be made so provided that the average content in the whole layer is in the above range. When the carrier charge blocking layer 1*a* is doped with a Group IIIa element, charging and developing bias of positive polarity and transfer of negative polarity are used. When the layer is non-doped or doped with a Group Va element, charging and developing bias of negative polarity and transfer of positive polarity are used.

As the Gruop IIIa and Va elements, boron (B) and phosphorus (P) are desirable for the same reason as described before. The thickness of the carrier charge blocking layer 1*a* is suitably in a range of 0.01 to 12 μm, preferably 0.1 to 5 μm, more preferably 0.1 to 2 μm. This thickness setting readily ensures necessary carrier charge blocking function and also permits suppression of residual potential increase.

Further, when the carrier charge blocking layer 1*a* is doped with O and/or N and/or C in a total amount range of 0.01 to 1 atomic %, it is possible to obtain further prevention of carrier introduction from the conductive support 11 and obtain further enhanced adhesion with respect to the support 11. The surface layer 1*c* which is laminated on the photoconductive layer 1*b* is made of an insulating or half insulating material.

The surface layer 1*c* is suitably an insulating layer or a high resistivity surface layer lest a charge pattern formed on it as a result of exposure should be destroyed due to trapping of charge and movement thereof in the film surface direction. Suitably, it is made of a material with a specific resistivity of $1\times10^{12}$ Ω·cm or above necessary for maintaining static electricity.

Particularly, the above surface layer 1*c* is a high resistivity surface layer of a-Si type, for instance a-SiC, a-SiN, a-SiO, a-SiCO, a-SiNO, etc. These layers may be formed by the same thin film formation means as a-Si type photoconductive layer 1*b*. In the case of using a-SiC for both the surface layer 1*c* and photoconductive layer 1*b*, the C content in the surface layer is set to be high compared to the C content in the photoconductive layer 1*b*. The C content in the surface layer 31 in terms of $Si_{1-x}C_x$ is suitably in an X range of $0.3\leqq X\leqq 1.0$, preferably $0.55\leqq X\leqq 0.95$. Such a-Si type high resistivity surface layer sis provided with H or a halogen element for the dangling bond termination purpose. Further, Group IIIa or Va element may be provided for electric characteristics adjustment.

In addition to the above materials, it is possible as well to use such inorganic insulating materials as a-C, a-B, a-BN, a-BC, $Al_2O_3$, etc. or such resin type insulating materials as silicone resin, polycarbonate, polystyrene, polyester, polybuthylene, polyethylene, fluorine resin, polysilane, polyimide resin, polyurethane, acrylic acid resin, etc.

The thickness of the surface layer 1*c* is suitably set to 0.05 to 10 μm, preferably 0.1 to 5 μm. If the thickness is below 0.05 μm, it is impossible to obtain sufficient insulation breakdown improvement or efficient charge trapping to contribute to the holding of electrostatic latent image. Further, in this case life in repeated use is deteriorated due to wear. If the thickness is above 10 μm, on the other hand, in the formation of a detailed charge pattern the electric field is spread in the layer in the film surface direction to result in reduction of the resolution. Therefore, it is impossible to obtain sufficient resolution. Further, charge remaining on the surface is increased to increase the residual potential, thus giving rise to the problems of image density reduction, back fog, image density changes in repeated use, etc.

Further, it is possible to provide a variation layer between the surface layer 1*c* and the photoconductive layer 1*b*. Suitably, such a variation layer has an element composition intermediate between those of the surface layer and photoconductive layer and has a composition slope in the thickness direction. With the provision of such variation layer it is possible to permit smooth running of photo-carriers formed in the photoconductive layer 1*b* to the surface of the surface layer 1*c*. The thickness of the variation layer suitably is 0.01 to 1 μm, preferably 0.05 to 0.5 μm.

The thickness of the overall photosensitive layer having the above constitution suitably is 2 to 25 μm, preferably 2 to 19 μm. The photosensitive layer of the a-Si photosensitive material according to the invention basically has a three-layer structure, and the ratio between the thickness d and relative dielectric constants er of the overall photosensitive layer is the resultant of the ratios between the thickness and relative dielectric constant of the individual sub-layers. Denoting the thicknesses of the photosensitive layer, surface layer, photoconductive layer and carrier charge blocking layer $1_a$ by $d_T$, $d_a$, $d_b$ and $d_c$ and the relative dielectric constants of these layers by $\epsilon_T$ $\epsilon_a$ $\epsilon_b$ and $\epsilon_c$, the resultant ratio is given as;

$$d_T/\epsilon_T=(d_a/\epsilon_a)+(d_b/\epsilon_b)+(d_c/\epsilon_c).$$

In the a-Si photosensitive material according to the invention, although the relative dielectric constant of the surface layer is slightly different from those of the other layers, because of a comparatively small total thickness and also because the photoconductive layer and carrier charge blocking layer have substantially the same relative dielectric constant, it is possible to let the relative dielectric constant $\epsilon_b$ of the photoconductive layer represent the overall relative dielectric constant $\epsilon_T$ (=$\epsilon r$) and let the thickness d represent the total thickness $d_T$. More specifically, in case of setting the relative dielectric constants to $\epsilon_a$=4 and $\epsilon_b$=$\epsilon_c$=12 and setting the thicknesses to $d_a$=0.5 μm, $d_b$=8.0 μm and $d_c$=0.5 μm, approximation may be made to $\epsilon_T$=$\epsilon_b$=12 and $d_T$=9.0 (μm), and in this case $d_T/\epsilon_T$(=d/$\epsilon r$)=0.8.

It is desirable that d/$\epsilon_r$ is 9 or below, preferably 0.05 to 8, more preferably 0.05 to 7. If d/$\epsilon r$ exceeds 9, charge $+Q_D$ induced by the toner is reduced, and in such case sufficient recording density can not be obtained. This can be seen from an increase of the thickness d and a reduction of attraction to toner. Reduction of d/$\epsilon r$ to be smaller than 0.05, on the other hand, is unsatisfactory in that the thickness of a-Si photosensitive layer, for instance, having a comparatively large relative dielectric constant of 12 is as small as 0.6 μm or below, which is insufficient to withstand the charging.

Figure 1B:
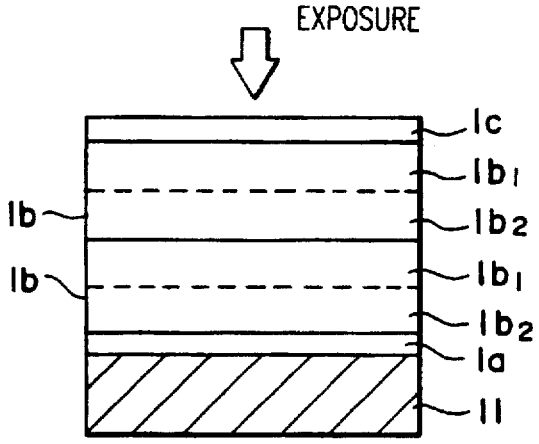
Figure 1C:
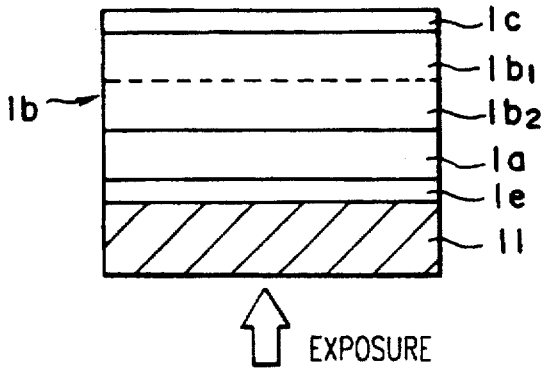

FIG. 1(B) shows the laminar structure of photosensitive layer in Carlson type electrophotographic apparauts, in which the photoconductive layer is formed by laminating I- and N-type semiconductor layers in case with the carrier charge blocking layer formed as a heavily doped P-type semiconductor layer, or in which the photoconductive layer is formed by laminating I- and N-type semiconductor layers in case with the carrier charge blocking layer formed as a heavily doped P-type layer. FIG. 1(C) shows the laminar structure of photosensitive layer in internal exposure type electrophotographic apparatus, in which the support 11 is made of transparent glass or transparent resin, and also in which a conductive film 1*e* is formed on the surface of the support 11.

The support 11 may be made of a transparent inorganic material, such as glass (e.g., Pirex glass, borosilicate glass, soda glass, etc.), quartz, sapphire, etc., or a transparent resin, such as fluorine resin, polyester, polycarbonate, polyethylene, polyethylene telephthalate, vinylon, epoxy, myler, etc.

The transparent conductive layer 1*b* may be made of a transparent conductive material, such as ITO (indium-tin-oxide), lead oxide, indium oxide, copper iodide, etc., or it may be formed by making Al, Ni, Au or like metal so thin as to be half transparent.

The developing unit 4 will now be described. The unit includes a developer vessel 41 accommodating a multiple component developer comprising a carrier and a toner, and a developing roller 42 accommodating a stationary magnet assembly 43. To the roller 42, a DC development bias source 44, the voltage of which can be set to 10 to several hundred volts, for instance, is connected for development.

As the carrier is used conductive ferrite carrier with an average particle diameter of 70 μm, but this carrier is by no means limitative, and it is possible to use as well such carrier as iron particles, magnetite, etc. or magnetic resin carrier.

As the toner is used usual high resistivity or insulating toner. For example, a magnetic toner with an average particle diameter of about 5 to 15 μm is produced by adding magnetic material to a binder resin, a coloring substance, a charge control substance, an off-set prevention substance, etc. The ratio between the carrier and toner is set to, for instance, 85 to 90 wt. %:15 to 10 wt. %, suitably. It is further possible to use a single component conductive magnetic toner as developer.

Such developer, i.e., two-component developer, is conveyed to the outer periphery of sleeve 42 to form a magnetic brush thereon. Development bias supply 44 connected to the sleeve 42 applies a voltage of + or −0 to 240 V in dependence on the potential characteristic between the sleeve 42 and photosensitive layer 1, whereby predetermined magnetic brush development is executed.

Now, the function of the low potential developing process according to the invention, which is carried out by the developing unit 4, will be described in comparison to the prior art with reference to FIGS. 12 and 13.

Figure 13A:
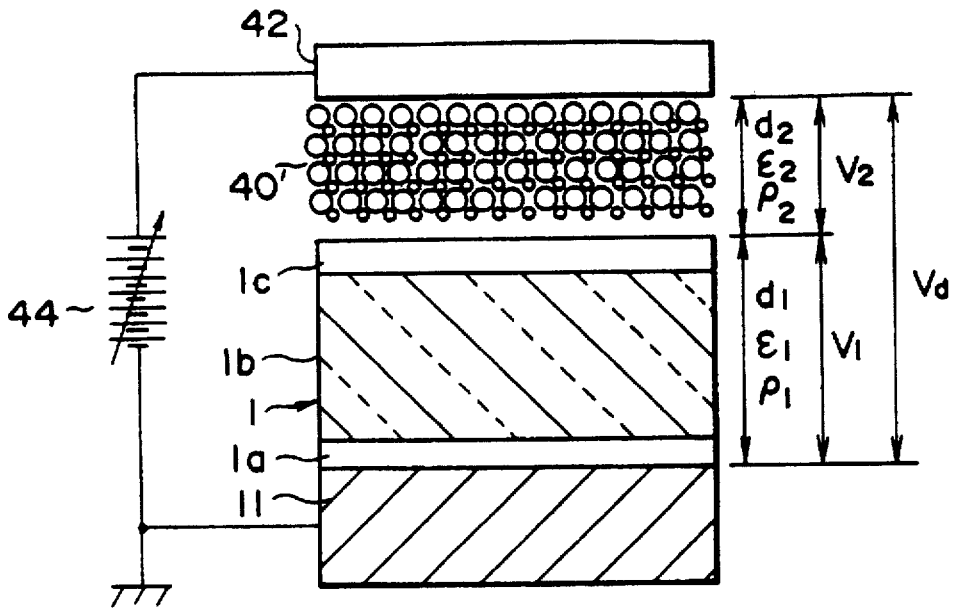
FIG. 13(A) PRIOR ART
FIGS. 13(A) and 13(B) show a prior art photosensitive drum and a developing section based on that developing process.
Figure 13B:
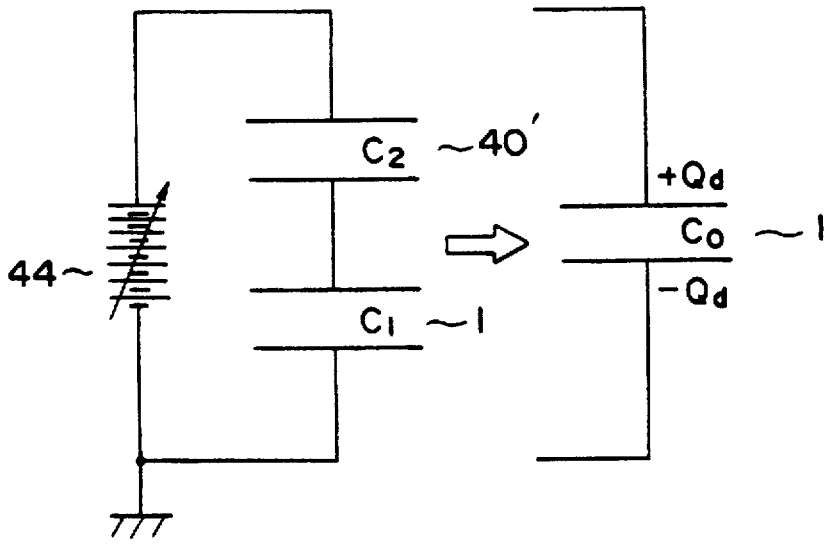
FIG. 13(B) PRIOR ART

FIG. 13(A) schematically shows a photosensitive drum and a developing section based on high potential developing process in the prior art. Referring to the Figure, designated at 10 is a photosensitive drum with photosensitive layer 1 laminated on conductive support 11, at 42 a conductive sleeve, and at 40' an insulating magnetic brush formed by a two-component developer comprising an insulating magnetic carrier and an insulating toner. In the Figure, $d_1$ and $d_2$ represent the thicknesses of the photosensitive layer and developer, $\epsilon_1$ and $\epsilon_2$ represent the dielectric constants of the photosensitive layer and developer, $\rho_1$ and $\rho_2$ represent the resistivities of the photosensitive layer and developer, and $V_d$, $V_1$ and $V_2$ represent the development potential and the potentials on the photosensitive layer 1 and developer 40, respectively. In the developing process based on the prior art Carlson system, an insulating magnetic brush 24 is formed by a two-component developer comprising an insulating magnetic carrier and an insulating toner or by a single component insulating magnetic toner between the surface of the photosensitive layer 1 and the conductive sleeve 42. Thus, in an equivalent circuit constituted by the photosensitive drum and developer in the developing section, it may be thought that the electrostatic capacitances $C_1$ and $C_2$ of the photosensitive drum and developer, respectively, are in series. The equivalent circuit is shown in FIG. 13(B). In the Figure, $C_O$ is the resultant electrostatic capacitance obtained from $C_1$ and $C_2$. $+Q_d$ and $-Q_d$ are respectively positive and negative charges induced by $C_O$ in the developing bias voltage. Assuming the dielectric constant of vacuum to be $\epsilon_O$(=8.85×10$^{-14}$ F/cm), $C_O$ is obtainable from the following formulas.

From $$C_1=(\epsilon_1/d_1)\times\epsilon_O$$

and $$C_2=(\epsilon_2/d_2)\times\epsilon_O,$$

$$C_O=1/[(1/C_1+1/C_2)]=\epsilon_O[(d_1/\epsilon_1)+(d_2/\epsilon_2)] \quad (1)$$

In the prior art developing process, both the photoconductive layer and the developer are nearly insulator, and the resistivities $\rho_1$ and $\rho_2$ are as great as 1×10$^{13}$ Ω·cm or above and can be ignored in the equivalent circuit shown in FIG. 13(B). However, when the resistivity of the developer is reduced or when the developer undergoes transition from an insulating state to a conductive state, the resistivity can no longer be ignored. In this case, the developer in the neighborhood of the conductive sleeve may be thought to be conductive because of fast resistivity reduction of the developer due to high density thereof. The developer in the neighborhood of the photosensitive drum, on the other hand, remains highly resistive because of its low density. Thus, the reduced thickness of the high resistivity developer may be obtained similarly from the above formula by regarding the thickness of the insulating developer to be $d_2$. Where the developer is conductive, $d_2$ can be regarded to be zero.

By exposure the potential on the photoconductive surface is reduced, and there is no surface potential on the bright areas of the photoconductive surface. Thus, the developing bias voltage $V_d$ induces negative charge of $-Q_d$ in the neighborhood of the conductive support supporting the photoconductive layer and positive charge $+Q_d$ in the toner which has higher resistivity than that of the carrier in the developer. The magnitude of the charges induced is given as;

$$Q_d=C_O\times V_d\epsilon_O\times V_d/(d_1/\epsilon_1+d_2/\epsilon_2) \quad (2)$$

In the bright areas of the photoconductive surface, the negative charge $-Q_d$ in the neighborhood of the conductive support supporting the photoconductive layer and the positive charge $+Q_d$ of the toner in the developer attract each other. Consequently, the toner receives forces attracting it to the photosensitive layer surface, and a toner image is thus formed thereon. At this time, the record image density is increased with increasing $Q_d$ in the above formula, but the development potentials $V_d$ that is necessary for obtaining $Q_d$ providing the same density is reduced with reduction of the term of $d_2/\epsilon_2$ for the developer layer for the same value of the term of $d_1/\epsilon_1$ for the photoconductive layer. This is considered to be the principle underlying the possibility of the low potential development according to the invention by using the conductive developer.

For example, for obtaining a record density of O.D.=1.3 by using the a-Si photosensitive layer according to the invention, with the setting of $\epsilon_1=12$ and $d_1=40$ μm for the photoconductive layer and $\epsilon_2=4$ and $d_2=40$ μm for the insulating developer layer, $V_d$ should be 800V. In this case, $Q_d$ is 0.053 μC/cm$^2$. On the other hand, with the setting of $\epsilon_2=0$ and $d_2=0$ μm for the conductive developer layer, $V_d$ should be 200V for obtaining the same $Q_d$.

Figure 12A:
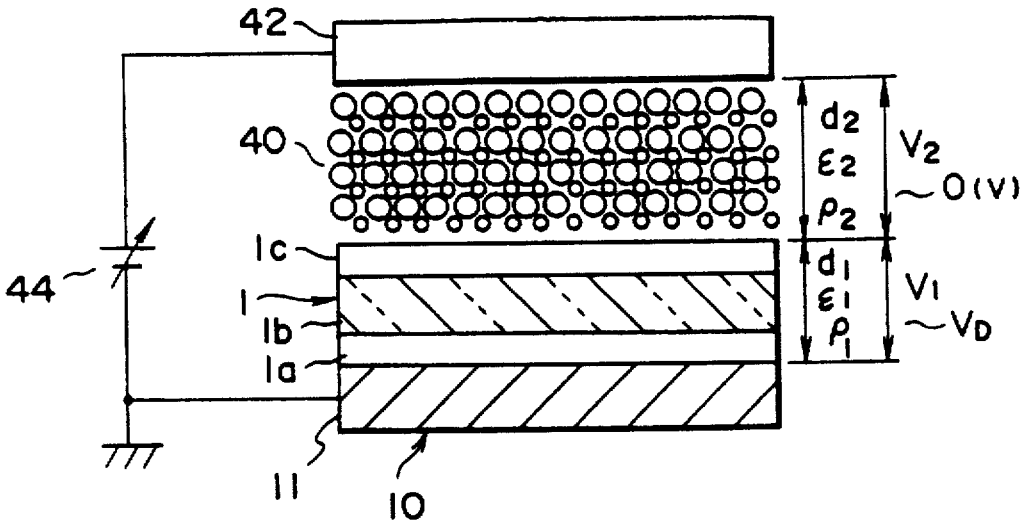
FIGS. 12(A) ands 12(B) show the photosensitive drum according to the invention and a developing section based on a low potential developing process.
Figure 12B:
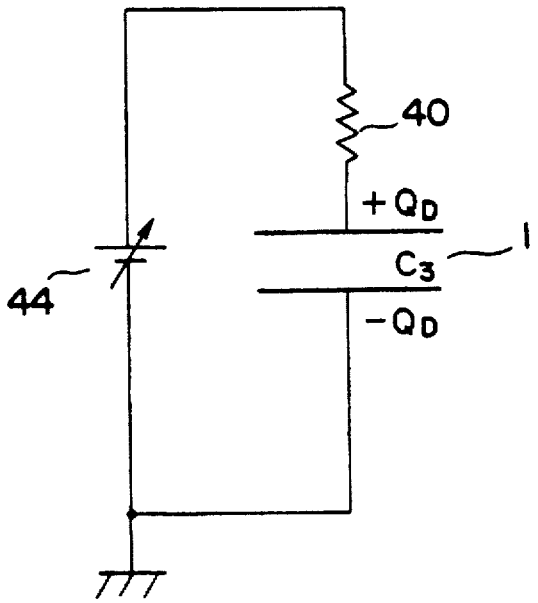

This will be described in greater detail with reference to FIG. 12(A) schematically showing the photosensitive drum and a developing section based on low potential developing process according to the invention and FIG. 12(B) showing an equivalent circuit of the illustrated system. In use here is a single component conductive magnetic toner or a two-component toner, which has a resistivity of $10^{10}$ Ω·cm or below, preferably $10^8$ Ω·cm or below, more preferably $10^2$ to $10^5$ Ω·cm. The insulating toner that is used has a resistivity of $10^{11}$ Ω·cm or above, preferably $10^{13}$ Ω·cm or above. This toner is mixed with the conductive magnetic toner to obtain the two-component developer with the resistivity thereof adjusted to the above value. Referring to FIG. 12(B), shown as $C_3$ is the resultant electrostatic capacitance from the electrostatic capacitances $C_1$ and $C_2$ of the photosensitive drum and developer respectively like those shown in FIG. 14(B), and shown as $+Q_D$ and $-Q_D$ are respectively positive and negative charges induced in $C_3$ by the developing bias voltage $V_D$.

As shown in FIG. 12(A), the low potential developer forms a conductive magnetic brush 40 between the photosensitive drum surface and conductive sleeve 42. According to the invention, the resistivity $\rho_1$ of the photosensitive layer is about $1\times10^{13}$ Ω·cm, while the resistivity $\rho_2$ of the developer is $1\times10^5$ Ω·cm or below and is ignorable. Thus, it may be thought that the space between the drum 1 and sleeve 42 is occupied by the conductive material having low resistivity of $\rho_2$. That is, $C_3$ in the equivalent circuit in FIG. 14(B) may be regarded to be constituted by the sole photosensitive drum capacitance $C_1$, the developer capacitance $C_2$ being ignored, and thus it is given as $$C_3=C_1=\epsilon_O\times(\epsilon_1/d_1) \quad (3)$$

After the exposure, because of absence of surface charge in the bright areas of the photosensitive drum surface, the developing bias voltage $V_D$ induces negative charge of $-Q_D$ in the carrier charge blocking layer 1*a* of the photosensitive layer and positive charge of $+Q_d$ in the toner having higher resistivity than the carrier in the developer At this time the terminal potential is $V_D$, and $Q_D$ is given as;

$$Q_D=C_3\times V_D=\epsilon_O\times V_D/(d_1/\epsilon_1) \quad (4)$$

In this low potential developing process, like the prior art developing process, the record image density is increased with increasing $Q_D$. Thus, in the low potential developing process according to the invention the record density is increased with increase of the photosensitive layer thickness $d_1$, and also with increase of the photosensitive drum relative dielectric constant $\epsilon_1$, and further with increase of the development voltage, i.e., bias voltage $V_D$.

For example, to obtain a record density of O.D.=1.3, as in the prior art, it is necessary to have $Q_D$=0.053 μC/cm$^2$. In this case, regarding the photosensitive layer to be with $\epsilon_1=12$ and $d_1=10$ μm and the developer to be with $\epsilon_2=0$ and $d_2=0$ μm, the necessary $V_D$ is reduced to 50 V.

Thus, in the photosensitive layer surface bright areas, even lower developing bias voltage $V_D$ can induce negative charge $-Q_D$ in the photosensitive layer and positive charge $+Q_D$ in the toner in the neighborhood of the photosensitive drum surface, the two providing electric attraction to each other to cause attraction of the toner to the photosensitive layer surface.

In the dark areas of the photosensitive drum surface, positive surface charge substantially equal to $+Q_D$ is present in the photosensitive layer and provides an electrostatic shielding function. For this reason, the attraction between the charges $+Q_d$ and $-Q_d$ is not provided, and the toner is not attracted to the photosensitive layer surface. Consequently, a toner image is formed on the photosensitive layer surface in correspondence to the bright and dark surface areas.

In the low potential developing process according to the invention, the charging potential on the photosensitive drum may be low. This means that the charging width in the charging process (i.e., opening width of corona discharge unit housing or contact width of charging roller or charging particles) may be small. Thus, a short charging time (of about 0.1 second or shorter) is set, and during this period the photosensitive drum is charged quickly. In this case, it may be thought that current supplied to the charger is sufficiently high and that charging loss stemming from leak current due to the dark resistance of the drum is ignorable. Thus, the current supplied at the time of the charging is mostly consumed for the charging, and the leak current in the photosensitive layer is as low as is ignorable.

Such an equivalent model of the photosensitive drum from an initial stage of charging till an instant right after the charging in a charging process, which takes short charging time and is assumed that sufficient current is supplied, may be thought to be able to ignore the resistive component so that it is constituted by the sole capacitive component C. The charge $Q_O$ (C/cm$^2$) which is produced in charging the photosensitive drum surface at this time, is given as;

$$Q_O = C \times V_O = (\epsilon r \times \epsilon_O / d) \times V_D \quad (5)$$

where $V_O$ (V) is the initial charging potential, $\epsilon r$ is the relative dielectric constant of the photosensitive layer, $\epsilon_O$ (F/cm) is the dielectric constant of vacuum, and d (cm) is the thickness of the photosensitive layer.

In order to obtain sufficient record density in the low potential developing process, $Q_O$ should be about 0.1 $\mu C/cm^2$, and $V_D$ should be about 50V. Substitution of these values in the above formula provides a value of $\epsilon r/d = 2.26 \times 10^4$. With a-Si photosensitive material, $\epsilon r$ is about 12, and d at this time is about $5 \times 10^{-4}$ cm=5 μm.

Now, charge distribution produced in the photosensitive layer in the process from charging till development in the low potential developing process according to the invention will be described with reference to FIGS. 14(A) to 14(C). These Figures are sectional views each showing the laminar structure of the photosensitive layer 1 and charge distribution in a corresponding process. The photosensitive layer 1 has a structure obtained by laminating carrier charge blocking layer 1*a*, photoconductive layer 1*b* and surface layer 1*c* on conductive support 11.

Figure 14A:
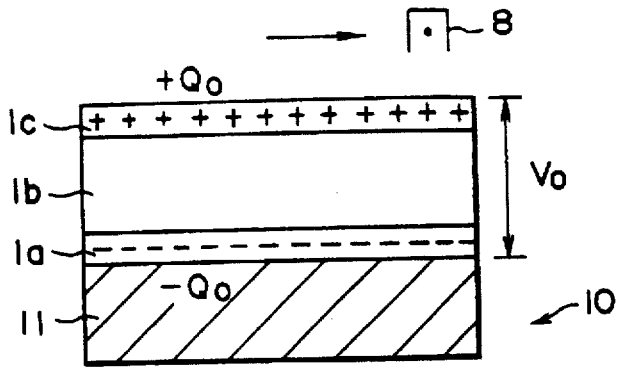
FIGS. 14(A) to 14(C) are sectional views showing the laminar structure of the photosensitive drum according to the invention and a charge distribution in image formatiponrocess.

In the charging process shown in FIG. 14(A), the charging means 8 induces charge $+Q_O$ of charging on the photosensitive layer surface and charge $-Q_O$ of the opposite polarity in the carrier charge blocking layer 1*a*. The photosensitive layer is thus charged to the initial charging potential $V_O$. Actually, this potential difference $V_O$ is distributed to the individual sub-layers of the photosensitive layer according to the resistances of the sub-layers.

Figure 7:
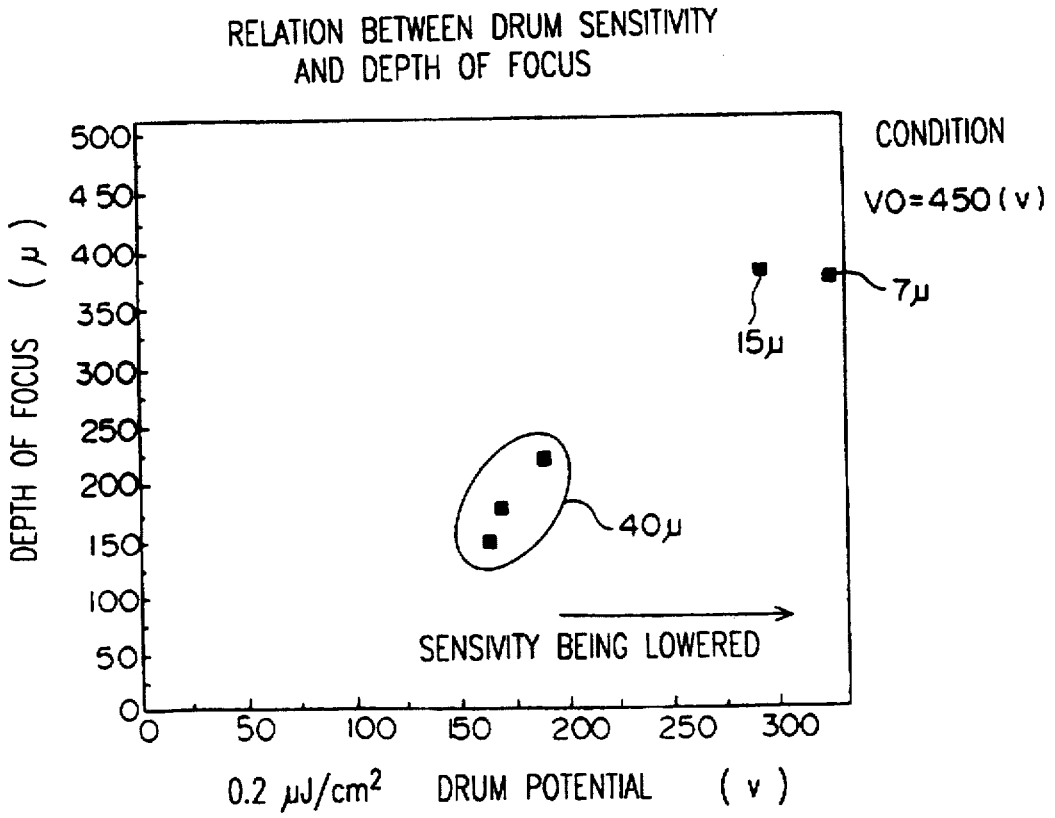
FIG. 7 is a graph showing the relation between the depth of focus and sensitivity of drum for certain thicknesses thereof.
Figure 8:
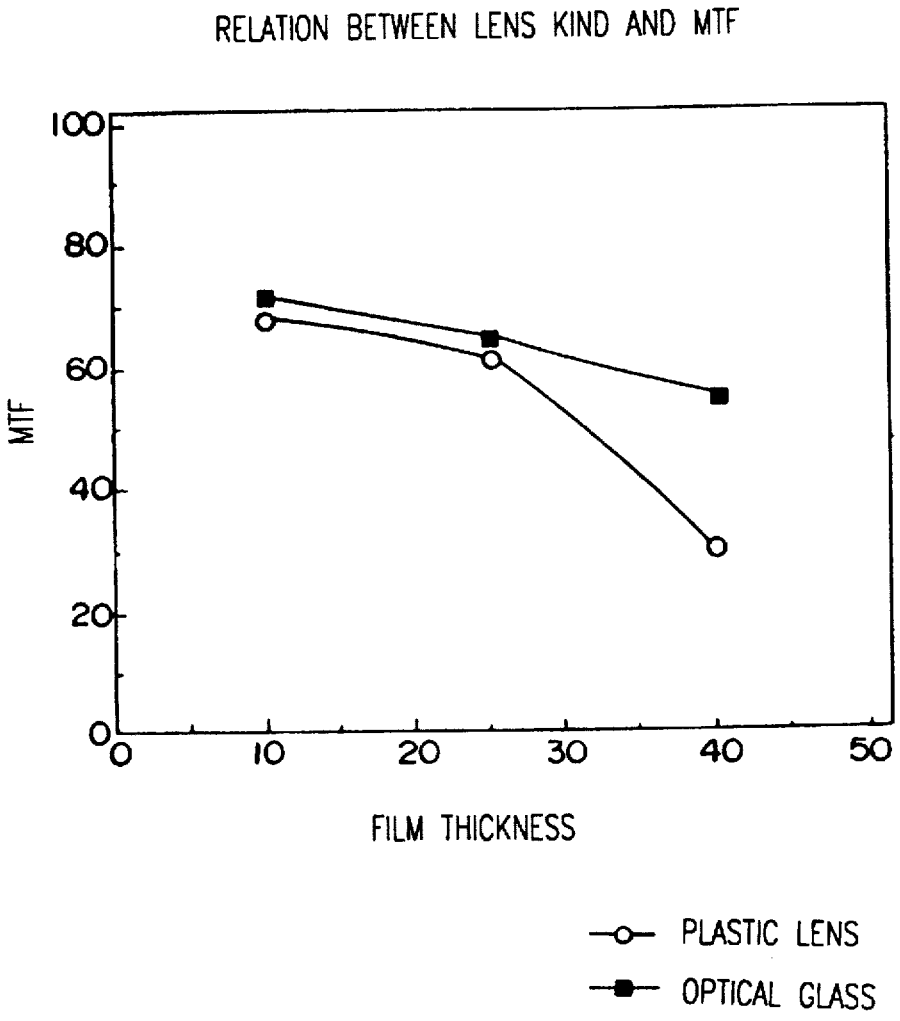
FIG. 8 is a graph showing the relation between the lens kind and thickness.
Figure 14B:
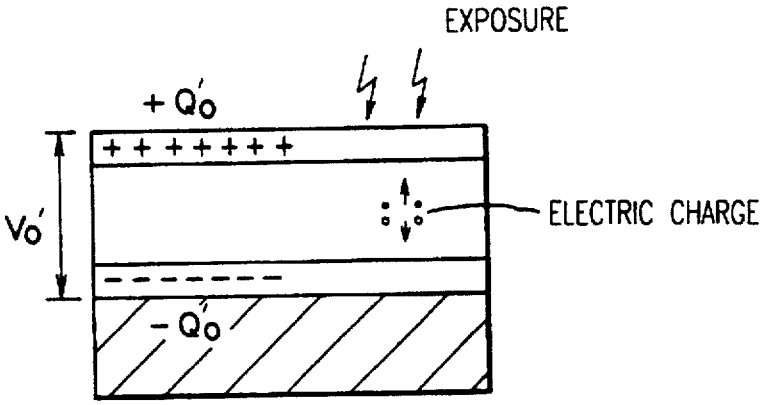
Figure 14C:
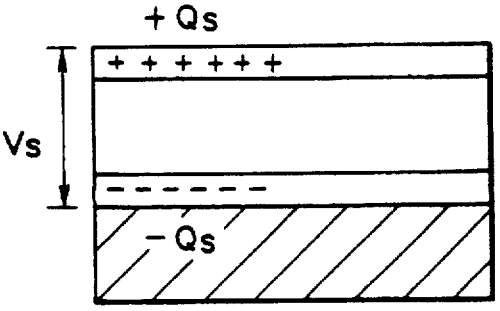
Figure 15:
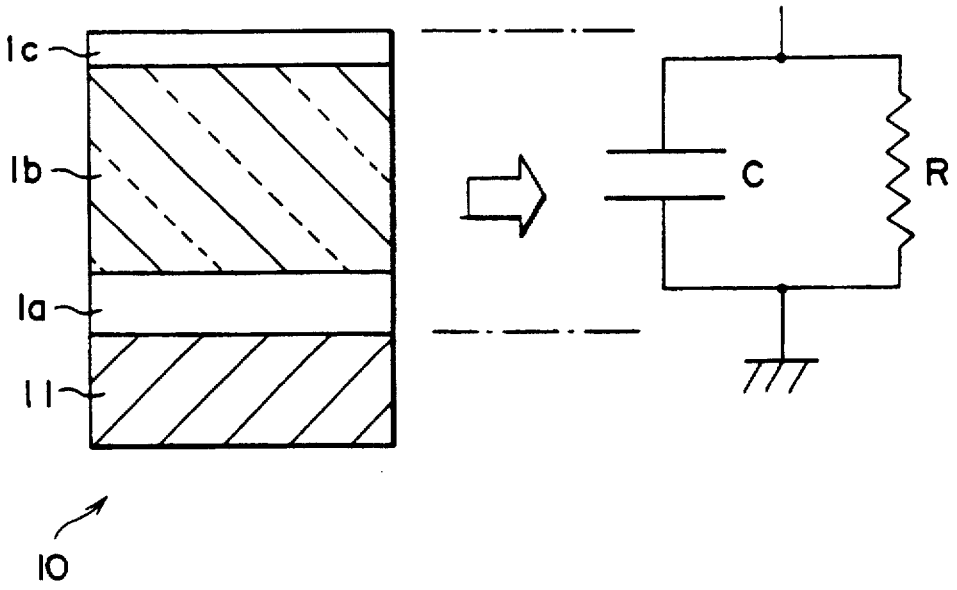
FIG. 15 shows an equivalent circuit of the photosensitive drum according to the invention.

The actual process from this charging through the exposure shown in FIG. 14(B) till the developing process shown in FIG. 14(C), requires about 0.1 to 3 seconds. Therefore, in the non-exposure areas the charge of charging and the charging potential are reduced due to dark discharge or commonly called dark attenuation in the photosensitive layer from $Q_O$ through $Q_O'$ to $Q_S$ and from $V_O$ through $V_O'$ to $V_S$. In this process, as the equivalent circuit of the photosensitive layer may be thought a parallel circuit of capacittor C and resistor R as shown in FIG. 7. Thus, the potential $V = V_O - V_S$ (V) which is reduced with the dark attenuation after the lapse of t seconds can be given as;

$$V = V_O \times exp(-t/(R \times C)) = V_O \times exp(-t/\tau) \quad (6)$$

$$\tau = R \times C = R \times (\epsilon_O \times \epsilon r/d) = \rho \times \epsilon_O \epsilon r \quad (7)$$

where τ is a time constant, and ρ is the resistivity of the photosensitive layer. In the above formulas, by setting the development potential $V_D$ to one half of the initial charging potential ($V_D/V_O = 0.5$) and the time from the charging till the developement to one second, $\rho = 1.4 \times 10^{12}$ Ω·cm because with the a-Si photosensitive layer $\epsilon r$ is about 12.

The actual measurement is less than the calculated value, and ρ of non-doped hydrated a-Si photosensitive layer is $10^{10}$ to $10^{11}$. However, it is possible to provide a greater value of $10^{11}$ to $10^{13}$ with doping of impurities in the photosensitive layer, alloying or laminar structure to be described later. Meanwhile, in the photoconductive layer 1*b* in the exposure areas, as shown in FIG. 14(B), photo-carriers 35 are generated by exposure E to reduce the resistance R in the equivalent circuit by about 3 digits. Consequently, the charges $+Q_O'$ and $-Q_O'$ are substantially perfectly discharged by bright discharging, resulting in the attenuation of $Q_O'$ substantially to zero and attenuation of $V_O'$ to several volts or below. When the developing process shown in FIG. 14(C) is reached by the photosensitive drum 1, in the non-exposure areas the charge $+Q_S$ of charging and charging potential Vs are held by the charge holding capacity. In the exposure areas, the charge of charging is substantially zero, and a surface charge distribution or an electrostatic latent image such that the charging potential is several volts or below is formed. This electrostatic latent image is developed in the above low potential developing process.

As shown above, in the dark areas the charging is done in a short charging time by current supplied from the charger. Thus, the resistance of the photosensitive layer can be ignored, and the equivalent circuit may be approximated with the sole capacitance component. In the dark attenuation process from the charging till the development, approximation is made with a model of parallel circuit of resistance and capacitance components. Unless the resistance component is great, sufficient surface charge can not remain at the time of the development. Thus, the necessary average dark resistivity of the photosensitive layer is $1 \times 10^9$ Ω·cm or above, as is seen from the measurement of the a-Si photosensitive layer.

On the other hand, in the bright areas the resistance of the photosensitive layer is sufficiently reduced with the generation of photo-carriers by exposure, and the discharging of the surface charge has been substantially completed until the start of development. This means that the average bright resistivity of the photosensitive layer in the bright areas should be lower than at least the average dark resistivity and $1 \times 10^9$ Ω·cm or below.

This requirement has to be met by the photosensitive layer applied to the low potential development according to the invention. In the low potential development, however, it is possible to apply up to materials with the bright resistivity thereof lower than about $1 \times 10^{10}$ Ω·cm in the prior art developing process. This is thought to be attributable to that owing to use at low potential there is redundant charging capacitance of the photosensitive layer, thus requiring correspondingly lower dark resistivity, that owing to small film thickness the dark attenuation due to thermal carriers is not much, thus requiring correspondingly dark resistivity, and further that owing to small thickness and use at low potential the sensitivity is satisfactory, thus providing for wide bright resistivity tolerance.

Further, according to the invention the above combination of small thickness photosensitive layer and low potential developing process, permits excellent quality image to be formed with a far low development potential compared to the prior art photosensitive drum. Experiments as follows were conducted according to the invention by using the above apparatus and photosensitive drums having different thicknesses.

In the experiments, a conductive ferrite carrier with an average particle diameter of 70 μm was used. The toner used was a usually high resistivity or insulating toner. Specifically, an insulating magnetic toner with an average center particle diameter of 5 to 15 μm was formed by adding a magnetic material to binder resin, coloring substance, charge control substance, off-set prevention substance, etc., and the ratio between the carrier and toner was set to, for instance, 85 to 90 wt. %:15 to 10 wt. %.

As the transfer roller 5 a conductive roller was used to increase the efficiency of transfer. A transfer bias of the opposite polarity to that of the charging potential on the toner was applied, and the roller was held in uniform forced contact with the periphery of the photosensitive drum 1 and rotated in synchronism therewith. As the charging unit 8, as shown in FIG. 2, was used a well-known corotron type charger for uniformly charging the photosensitive drum. Designated at 81 is corona discharge line, at 82 a control grid, at 83 a discharge bias, and at 84 a charging control bias.

Under the above conditions, a high voltage discharge bias was applied with the charging control bias set to a suitable bias voltage, thus charging the photosensitive drum 1 to the initial charging potential $V_O$ of the following setting value. Then, exposure was made with the exposure head 2 to form a predetermined latent image. Then, a toner image is caused to be attached to the latent image while adjusting the development bias with the developing unit 4. Then, the toner image was transferred onto recording paper with the transfer roller 5 and then fixed with the fixing roller, thus obtaining a fixed image.

First, a photosensitive layer having a thickness of 0.6 μm (carrier charge blocking layer 1*a:* 0.1 μm, photoconductive layer 1*b:* 0.4 μm, surface layer 1*c:* 0.1 μm), is formed on an aluminum cylindrical member having a thickness of 1.5 mm and an outer diameter of 30 mm, and with this drum 10,000 images were developed with the initial charging potential set to 100V, the surface potential at the time of the development set to 80V, and the developing bias voltage set to 50V. It was impossible to obtain image satisfactory in both the image density and the fog.

Then, a photosensitive layer having a thickness of 9.0 μm (layer 1*a:* 4.0 μm, layer 1*b:* 4.5 μm, layer 1*c:* 0.5 μm) was formed on the above aluminum cylindrical member with the thickness of 1.5 mm, and this drum was used to make development by setting the initial charging voltage to 145V, the surface potential at the time of the development to 145V and developing bias voltage to 90V. Images that were obtained were of image density of O.D.=1.4 or above and satisfactory both in the fog and the resolution.

Further, a photosensitive layer having a thickness of 25 μm (layer 1*a:* 4.0 μm, layer 1*b:* 20.5 μm, layer 1*c:* 0.5 μm) has formed on an aluminum cylindrical member with a thickness of 2.5 mm, and with this drum 10,000 images were developed with the initial charging potential set to 360V, the surface potential at the time of the development set to 300 V and the developing bias voltage set to 240V. Images that were obtained were of record density of O.D.=1.3 or above, and were satisfactory in both the fog and the resolution. Still further, a photosensitive layer having a thickness of 40 μm (layer 1*a:* 4.5 μm, layer 1*b:* 20.5 μm, layer 1*c:* 1.0 μm) was formed on an aluminum cylindrical member having a thickness of 4.0 mm, and with this drum 10,000 images were developed by setting the initial charging potential to 450V, the surface potential at the time of the development to 340V and the developing bias voltage to 240V. It was impossible to obtain satisfactory images from an initial stage of development.

Now, the relation of the thickness of the photosensitive layer to the exposure and charging will be considered.

As the photosensitive drum 1 were produced those with photosensitive layer thicknesses of 7, 10, 15, 20, 25 and 40 μm, as will be described later, by successively laminating the carrier charge blocking layer 1*a*, photoconductive layer 1*b* and surface layer 1*c* on an aluminum cylindrical member having a thickness of 2 mm by using a capacitive coupling glow discharge decomposition apparatus.

In this case, the thickness of the surface layer 1*c* was set to 3 μm max. or below and substantially 5% or below of the total thickness; specifically, it was set to 0.1 to 3 μm. The resistivity of the layer 1*c* was set to $10^{12}$ to $10^{13}$ Ω·cm.

Regarding the drum with the layer thickness of 40 μm, the true circularity could not be obtained with the aluminum cylindrical member with the thickness of 2 mm. Therefore, the film was formed once again, but the result was not satisfactory.

Accordingly, in this embodiment film formation was further made by using an aluminum pipe with a thickness of 4 mm. In this case, true circularity could be obtained.

It could be understood that the thickness reduction enabled making the support, i.e., aluminum cylindrical member, thinner, thus permitting weight reduction.

As the LED head 2 for exposure, head arrays with exposure wavelengths of 685 and 740 nm were used, and they are each driven by dynamic driving for division exposure of 64 bits by 40 times for each scanning line.

For the development, to the developing unit 4 may be connected the DC developing bias supply 44, the voltage of which can be set to a desired value between, for instance, 10 and 450V.

As the developer, charging unit 8 and transfer roller 5 may be use those which are in the above embodiment.

The surface of the photosensitive drum 1 was charged to the following initial charging potential by setting a predetermined charging bias with a discharge bias applied by suitably setting the charging control bias in a range of about 150 to 450V, then the drum 1 was exposed with the exposure head 2 to form a latent image, and then the latent image is developed with the developing unit 4, the toner image being subsequently transferred using the transfer roller 5.

With these means used together with each of the photosensitive drums 1 having different film thicknesses, the following experiments were conducted.

Figure 5:
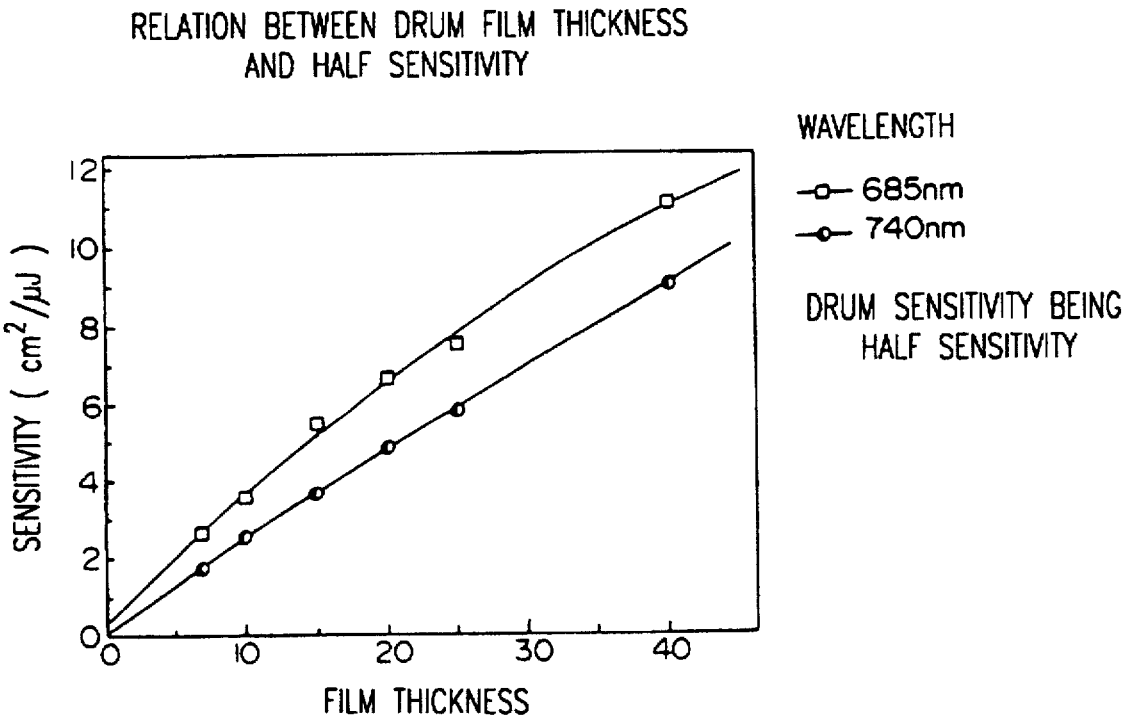
Figure 10A:
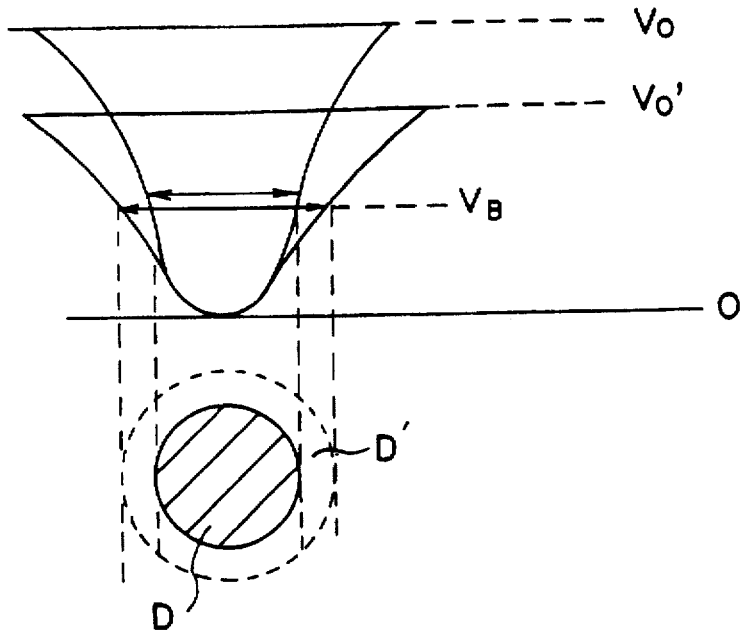
FIG. 10(A) shows the relation between surface potential and latent image potential distribution when the surface potential is reduced, particularly showing the state of toner dot diameter increase (image flow)

FIGS. 4 and 5 are a table and a graph, respectively, showing the relation between the thickness of a-Si photosensitive layer and half sensitivity thereof. After adjusting the charging bias such that the initial charging potential on the photosensitive drum 1 is 200V, the half sensitivity of each of the photosensitive drums with the different thicknesses (i.e., exposure energy density necessary for the exposure potential reduction to one half the surface potential) was examined by adjusting the output of the exposure head 2. It was observed that the half sensitivity was reduced in proportion to the drum thickness. Particularly, with the photosensitive drums with film thicknesses of 25 μm and below, the half sensitivity of which is reduced greatly compared to the prior art photosensitive drum with the film thickness of 40 μm, even when the latent image potential distribution is slightly spread with the reduction of the surface potential $V_O'$ as shown in FIG. 10(A) along with the latent image potential distribution width reduction, the light dose of the edge of the distribution is not picked up, but only the central light dose is picked up, thus permitting formation of high quality dot image with high image contrast and sharpness.

It will be understood that such effect is low with the exposure wavelength of 740 nm compared to 685 nm, the wavelength 740 nm being more effective for the formation of high quality dot image with high image contrast and sharpness without picking up aberration light doses due to focus errors and other causes but by picking up only the central light dose.

Figure 9A:
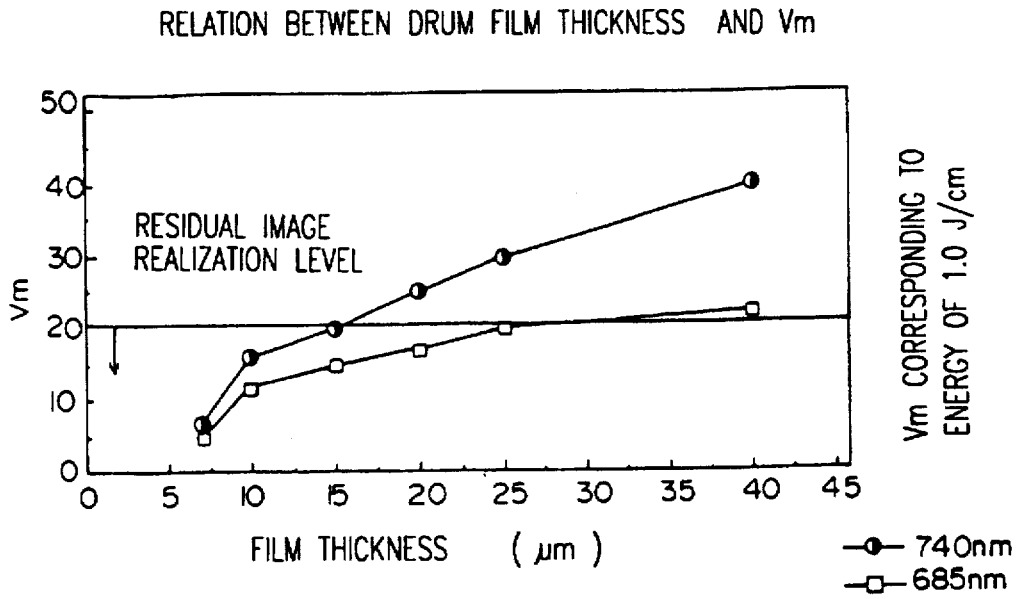
FIGS. 9(A) and 9(B) are graphs showing the relation between expoure development with 740 or 685 μm and the esidual image realization level, FIG. 9(A) being a graph with the abscissa axis taken for the thickness f or comparing exposure wavelengths, FIG. 9(B) being a graph with the abscissa taken for the exposure wavelength for comparing the film thickness.

FIG. 9(A) shows the relation between the exposure potential and film thickness when exposure image of a focusing energy level of 1.0 μJ/cm$^2$ is written on each of the photosensitive drums 1 with the different thicknesses after adjusting the output of the exposure head 2 such as to provide the above energy level subsequent to the adjustment of the charging control bias or the like such that the initial charging potential $V_O$ on the photosensitive drum 1 is 200V. As is obvious from the Figure, when exposure image with the exposure wavelength of 685 nm is focused on the drum 1, the exposure potential is formed along a residual image realization level line with a photosensitive film thickness in a range of 40 to 25 μm. However, with further thickness reduction the exposure potential is reduced proportionally to be lower than the residual image realization level.

On the other hand, when exposure image with the exposure wavelength of 740 nm is focused on the photosensitive drum 1, with the thickness of 40 μm the exposure potential is high compared to the case of the exposure wavelength of 685 nm and is above the residual image realization level. However, with thickness reduction from 40 μm noted above, the exposure potential is reduced proportionally and becomes lower than the residual image realization level with a thickness around 25 μm.

Figure 9B:
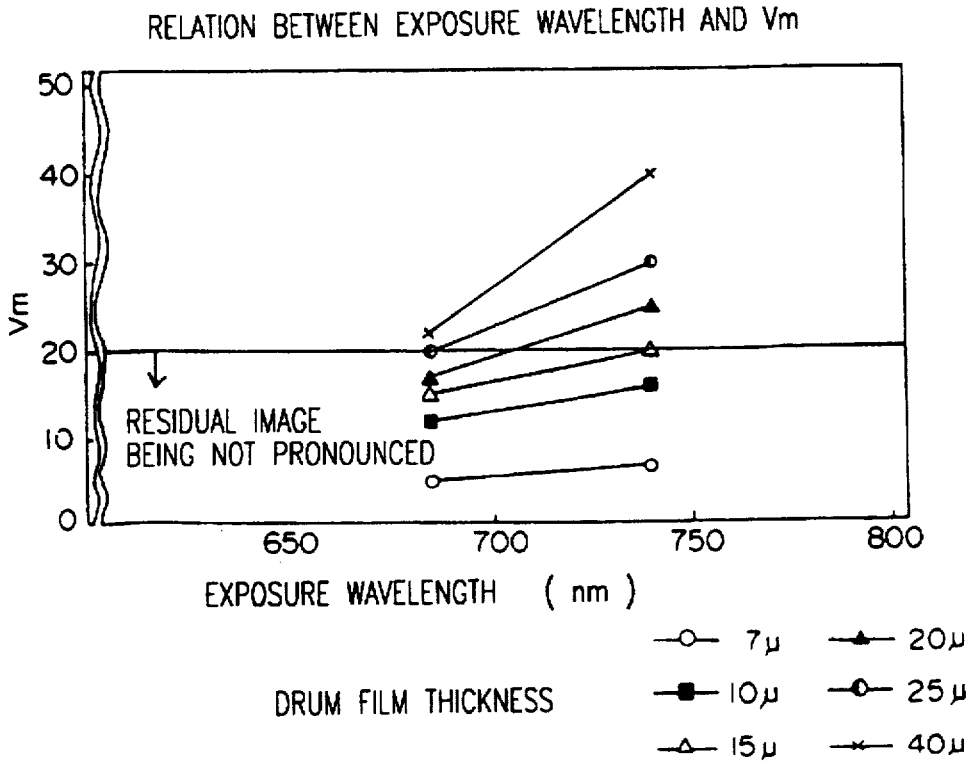

FIG. 9(B) shows the relation between the exposure wavelength and exposure potential which was examined for each thickness. It will be seen from the Figure that by setting the drum thickness to 25 μm or below it is possible to maintain the exposure potential to be below or in the neighborhood of the residual image realization level even with the exposure wavelength set to 700 nm or above.

Figure 6A:
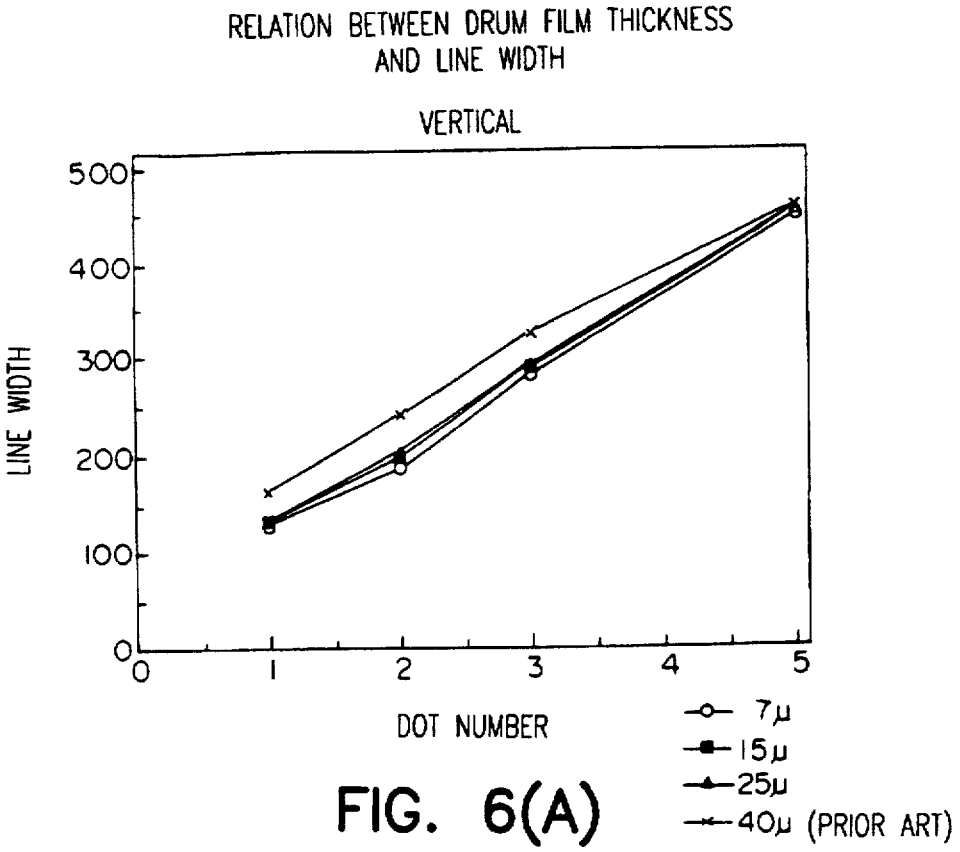
FIGS. 6(A) and 6(B) showing the relation between line width and thickness of drum, FIG. 6(A) being for horizontal line case, FIG. 6(B) being for vertical line case.
Figure 6B:
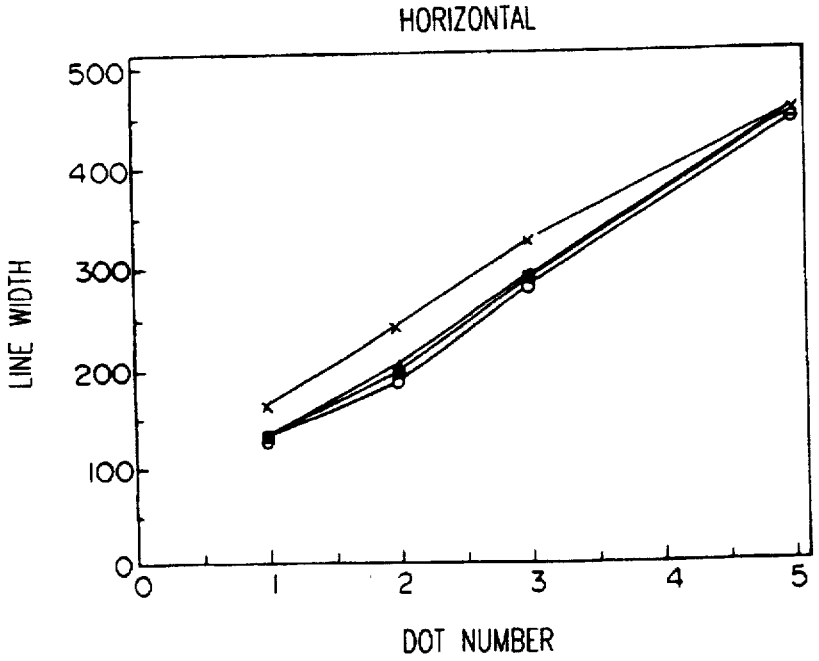

FIG. 6 shows the relation between the drum thickness and line width obtained when exposure image is written at a focusing energy level of 1.0 μJ/cm$^2$ on each of the photosensitive drums 1 with the different thicknesses using a LED head with exposure wavelength of 740 nm after adjustment of the output of the exposure head 2 such as to provide the above energy level subsequent to the adjustment of the charging control bias or the like such that the surface potential $V_O$ on the drum 1 is 200V.

Figure 10B:
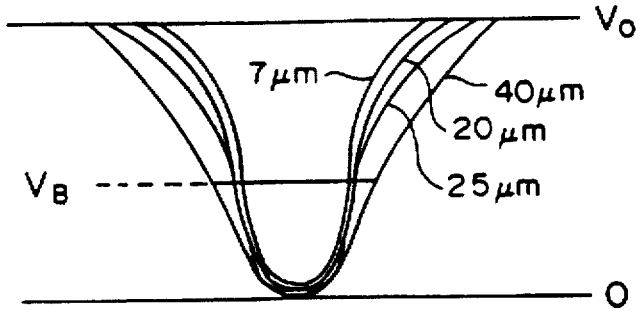
FIG. 10(B) shows the relation between photosensitive drum film thickness and latent image potential level.

It will be seen from the Figure that in either horizontal or vertical line case, with photosensitive layer thickness of 40 μm or below, the line width is great compared to that with thickness of 25 μm or below. Thus, the sharpness and resolution are correspondingly low. In consequence, the latent image potential distribution is spread, as shown in FIG. 10(B). With thickness of 25 μm or below, both the sharpness and resolution are substantially in accord. In consequence, the latent image potential distribution width is smaller, as shown in FIG. 10(B).

FIG. 7 shows the relation between the depth of focus and drum sensitivity when exposure is made with an exposure wavelength of 740 nm and energy density of 0.2 μJ/cm$^2$ after charging the drum to an initial charging potential of 450V. With the thicknesses of 7 and 15 μm, compared to thethickness of 40 μm, the depth of focus is improved, that is, it is almost doubled to 370 μm. The increase of the depth of focus does not only reduce the generation of bur on the latent image potential distribution edge with reduction of the surface potential $V_O'$ as shown in FIG. 1(B), but also permits rough setting the machining and assembling accuracies of the optical system for focusing exposure image on photosensitive drum, thus greatly reducing image quality fluctuations.

It will be understood from the above results that when exposure is made with the exposure wavelength of 700 nm or above by charging the photosensitive drum to an initial charging potential of 450V or below, it is possible to form high resolution image free from residual image and having high sharpness by setting the thickness of photosensitive layerto be 25 μm or below.

Now, the relation between the image flow and photosensitive drum thickness will be described.

Figure 11:
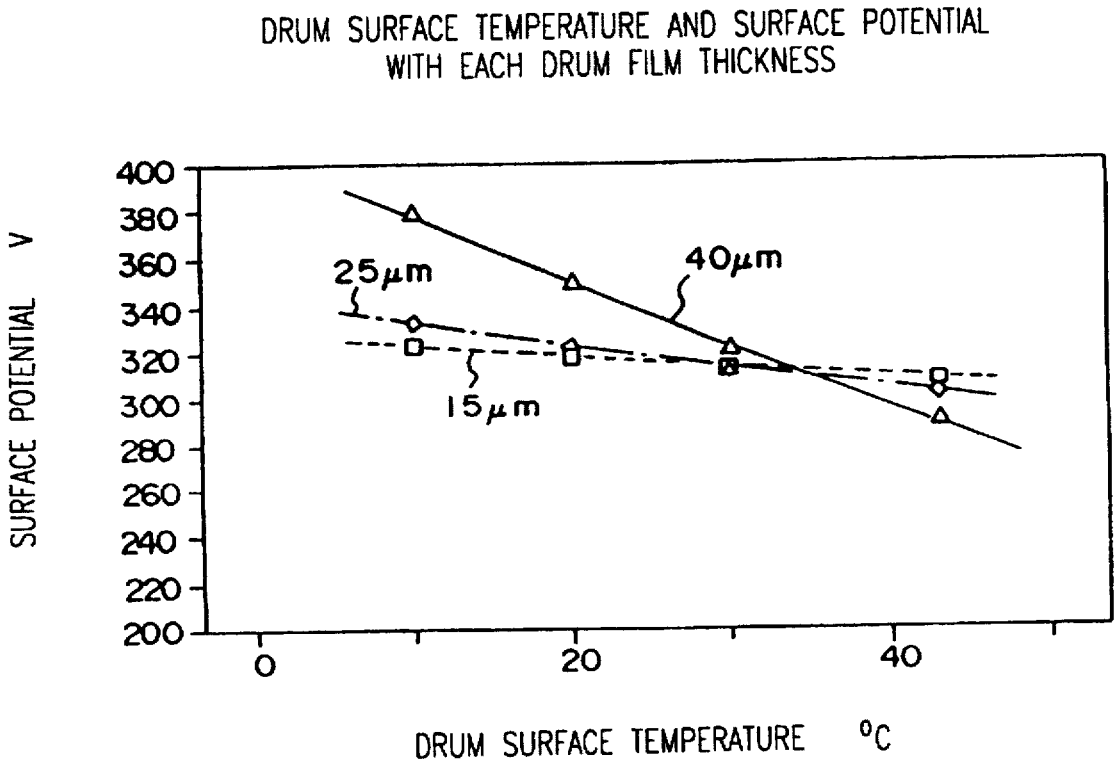
FIG. 11 is a graph showing the relation between drum film thickness of a-Si photosensitive drum and half sensitivity, i.e., the relation between drum film thickness and surface potential when the apparatus temperature is changed while maintaining a constant charging potential bias.

FIG. 11 shows the relation between a-Si photosensitive drums with thicknesses of 15, 25 and 40 μm and the surface potential when the apparatus temperature is changed to 10,20, 30 and 43° C. in a state obtained by using an a-Si photosensitive drum having a thickness of 40 μm such that the charging control bias is held constant subsequent to the adjustment of the charging control bias, etc. such as to obtain an initial charging potential to 320 V at a temperature of 30° C.

As will be understood from the Figure, the photosensitive drum having a thickness of 40 μm had high temperature dependency, with the potential change with temperature change of 10° to 40° C. being 80 V (2.7 V/°C.), while with the drums having thicknesses of 25 and 15 μm, the temperature dependency is greatly reduced, with the potential change with temperature change of 10° to 40° C. being 30 V (1.0 V/°C.) with the former drum and 15 V (0.5V/°C.) with the latter.

It is thus possible to suppress variations of the surface potential $V_O$ due to environmental variations by setting the thickness of the photo sensitive drum to 25 μm or below.

Using each of photosensitive drums having thicknesses of 25 and 15 μm, printing of 180,000 copies (corresponding to substantially 300 hours) was made without use of any heater in the drum and by varying the apparatus temperature up and down with a temperature gradient of 10° C./hr. from 10° C. to 40° C. or from 40° C. to 10° C. in a state with the initial charging potential $V_O$ of the drum set to 300V and the developing bias set to 210V. With either photosensitive drum it was possible to obtain sharp image free from fog.

Then, using photosensitive drum having thickness of 40 μm, printing was similarly made without use of any heater in the drum and by varying the apparatus temperature up and down with a temperature gradient of 10° C./hr. between 10° and 40° C. and under a medium relative humidity condition in a state with the initial charging potential $V_O$ on the drum set to 450 V and the developing bias set to 250V. In this case, image flow was generated in a short period of time.

In this embodiment, it is thus possible in an electrophotographic apparatus using an a-Si photosensitive drum to obtain sharp image formation under considerations of the structural simplification and safety and without possibility of fog or image flow generation irrespective of temperature or like environmental changes.

Figure 3:
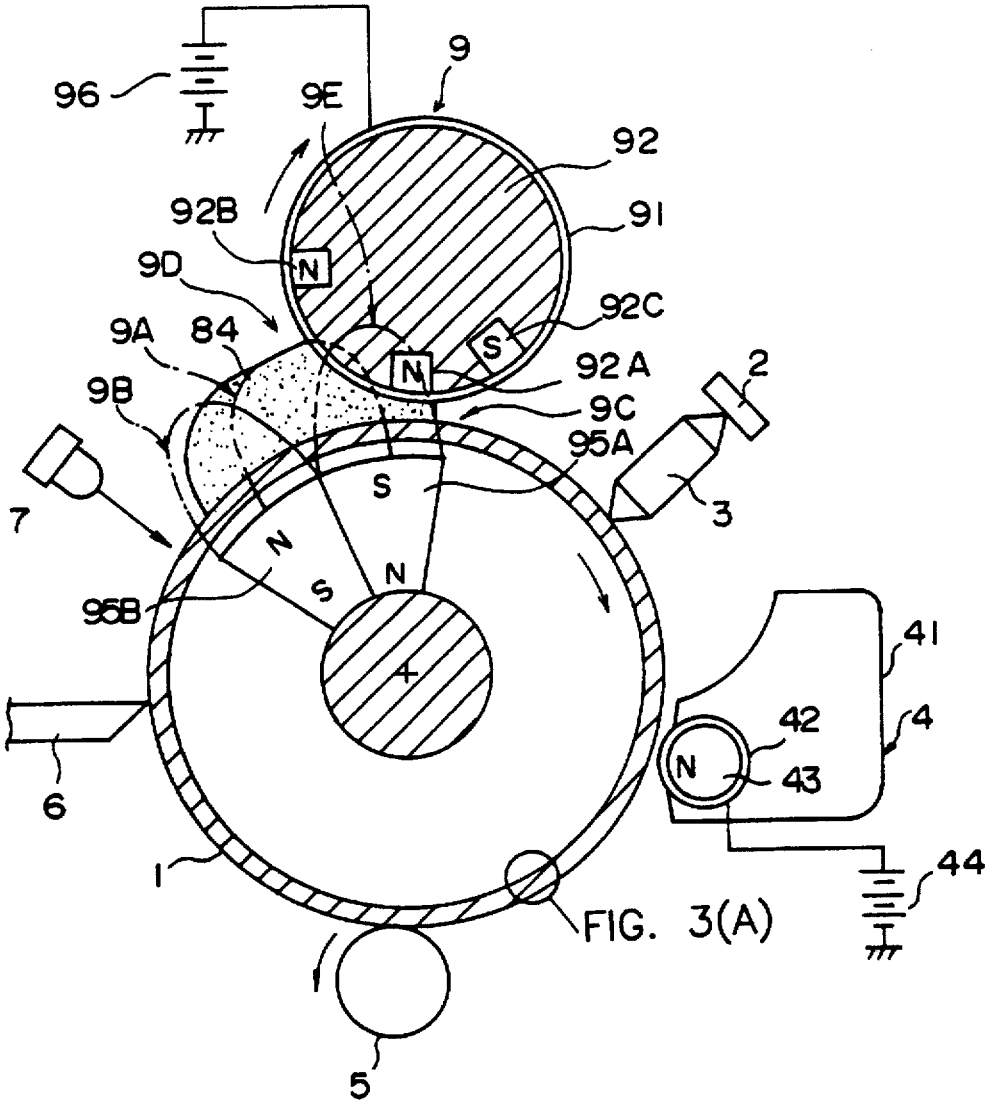
FIGS. 3 and 3A are schematic views showing an electrophotographic apparatus with particle charging means in an embodiment of the invention.
Figure 3A:
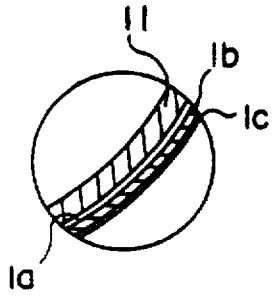

FIGS. 3 and 3A show a different embodiment of the invention using a particle charging unit. As shown in the Figures, in the particle charging unit 90 a non-magnetic sleeve 91 is provided such that it faces a photosensitive drum 1, which is rotating clockwise in the Figure, via a charging gap (0.5 mm) and that it is rotated in the direction opposite to the direction of rotation of the drum 1 (i.e., in the counterclockwise direction). A stationary magnet 92A is disposed on the downstream side of the charging zone of the back surface of the non-magnetic sleeve 91. Also, a repulsing magnet 92B of the same polarity as that of the stationary magnet 92A is disposed on the upstream side of the charging zone of the magnet 92A, i.e., downstream the charging zone in the direction of the sleeve rotation. Further, a magnet 92C of the opposite polarity to that of the stationary magnet 92A is disposed on the upstream side in the sleeve rotation direction.

Designated at 96 is a bias supply for applying a charging bias to conductive magnetic particles 94 via the non-magnetic sleeve 92.

The conductive magnetic particles which are provided in the charging zone are not particularly limited so long as they are conductive. They may be constituted by such a conductive particles as ferrite, iron particles, magnetite, etc. covered by a conductive resin on the magnetic core, or they may be blend particles 84 obtained by mixing conductive particles and magnetic particles. Further, it is possible to use what is obtained by magnetic particles with an average particle diameter of 30 μm as base material and conductive particles with an average particle diameter of 15 μm in a suitable ratio.

This embodiment uses what is constituted by ferrite core particles with an average grain diameter of 20 to 35 μm and a resistivity of $10^5$ to $10^6$ Ω·cm and has a set magnetic characteristic of 60 to 70 emu/g (1 kOe).

On the back side of the photooosensitive drum 1, on the other hand, a first and a second magnet 95A and 95B are disposed side by side. The first magnet 95A substantially faces the stationary magnet 92A located downstream the charging zone, and the second magnet 92B is disposed upstream the charging zone. The first magnet 95A has S pole, the opposite polarity to that of the stationary magnet 92A, and cooperates with the magnet 92A to form a vertical magnetic field. The second magnet 95B has N pole, the opposite polarity to that of the first magnet 95A, and forms a horizontal magnetic field over the photosensitive drum 1 between the two magnets 95A and 95B.

In this embodiment, the magnetic particles 94 are attached in close contact attachment to the charging zone of the photosensitive drum 1 in the horizontal magnetic field between the N and S pole magnets 95A and 95B. Also, in the vertical magnetic field spaced apart from the horizontal magnetic field and downstream the charging zone, they are attached in a coarse state such that they are upright in the normal direction to the drum 1.

When the photosensitive drum 1 is rotated in this state, the magnetic particles 94 are moved from the horizontal magnetic field to the vertical magnetic field while charging the drum 1 in the horizontal magnetic field, and owing to the vertical magnetic field 9E they escape in the vertical direction without being carried to the downstream side by a non-magnetic force zone 9C formed on the drum 1 by the repulsive magnetic field formed with respect to the S pole magnet 92C.

The magnetic particles 94 that have been directed in the vertical direction, are attached to the sleeve 91 by the attractive force with respect to the stationary magnet 92A, and with the rotation of the sleeve 91 they are subsequently pulled back toward the horizontal magnetic field 9A upstream the charging zone. Consequently, a non-magnetic force zone 9D is formed between the two poles 92A and 92B.

In consequence, the magnetic particles 94 are moved from the horizontal magnetic field 9A to the vertical magnetic field 9B, and they fall onto the charging zone without being carried to the downstream side by the non-magnetic force zone formed by the repulsion between the N pole magnet 92B and stationary magnet 92A.

In the horizontal magnetic field noted above, the magnetic particles 94 are held in close contact with the photosensitive drum 1 to smoothly charge the surface thereof. Then, the drum 1 is exposed with the exposure head 2 to form a latent image on it. The latent image is then developed by the developing unit 4 to obtain a toner image, which is then transferred by the transfer roller 5.

An example of printing was carried out by using such apparatus comprising, as the photosensitive drum 1, one with the total photosensitive layer thickness set to 25 μm. The applied voltage of the charging bias supply 96 was set to 250, 350 and 700V, and the developing bias was set to 150V. First, printing of 10,000 copies was made, followed by leaving the apparatus for 8 hours under conditions of 35° C. and 85% RH, then printing of 100 copies was made, and then the status of image flow was checked. In either case, no image flow was generated.

Then, the above 100 copies were checked again for minute image flow by using a 10 times enlarger. Slight image flow was recognized in the first two copies in the case where the applied voltage of the charging bias supply 96 was set to 600V.

With the above photosensitive drum, the initial charging potential was checked. It was 200V when the applied voltage of the charging bias source 96 was set to 250 V, 280V when the applied voltage was 350V, and 600V when the applied voltage was 700V.

Thus, with this embodiment it is possible even with an apparatus using a particle charging unit to eliminate image flow without structural complication. It is thus readily possible to permit durability enhancement and realize free maintenance, these effects being promoted by reducing the charging bias voltage to the DC bias voltage of 600V or below.

What is claimed is:

1. An electrophotographic apparatus with exposure means disposed on a photosensitive drum, the drum being supported on a support or disposed inside the support, wherein: the photosensitive drum is an a-Si photosensitive drum having a thickness below a surface layer of substantially 2 to 25 μm, wherein the thickness d of a photoconductive layer in the photosensitive drum is set to 2 to 24 μm, the relative dielectric constant r of the photoconductive layer is set to 2 or above, and d/er is set to 9 or below.

2. The electrophotographic apparatus according to claim 1, wherein the photosensitive drum is supported on the support and the support comprises at least one of a cylindrical transparent support and a cylindrical aluminum support and has a thickness set to 3 mm or below.

3. An electrophotographic apparatus with exposure means disposed on a photosensitive drum, the drum being supported on a support or disposed inside the support, wherein: the photosensitive drum is formed on a conduct support such that it has a three-layer structure comprising a carrier charge blocking layer for blocking the introduction of carrier charge of the opposite polarity to that of charging from the conductive support into a photoconductive layer, the photoconductive layer, and a surface layer constituted by an insulating or high resistivity layer, the thickness of the photoconductive layer being set to 2 to 24 μm, wherein the carrier charge blocking layer is a heavily doped P-type semiconductor layer, and the photoconductive layer is an I- or N-type semiconductor layer or a semiconductor layer formed by laminating I- and N-type sub-layers.

4. An electrophotographic apparatus with exposure means disposed on a photosensitive drum, the drum being supported on a support or disposed inside the support, wherein: the photosensitive drum is formed on a conduct support such that it has a three-layer structure comprising a carrier charge blocking layer for blocking the introduction of carrier charge of the opposite polarity to that of charging from the conductive support into a photoconductive layer, the photoconductive layer, and a surface layer constituted by an insulating or high resistivity layer, the thickness of the photoconductive layer being set to 2 to 24 μm, wherein the carrier charge blocking layer is a heavily doped N-type semiconductor layer, and the photoconductive layer is an I- or N-type semiconductor layer or a semiconductor layer formed by laminating I- and N-type sub-layers.

5. An electrophotographic apparatus with exposure means disposed on a photosensitive drum, the drum being supported on a support or disposed inside the support, wherein: the photosensitive drum is an a-Si type photosensitive drum having a thickness of substantially 2 to 25 μm, and the apparatus has developing means with a conductive magnetic brush formed by a developer comprising a combination of a conductive magnetic carrier and an insulating toner or comprising a uni-component conductive magnetic toner, wherein the development contrast potential between exposed and non-exposed areas of the surface of the photosensitive drum in contact with the magnetic brush i.e., potential difference between dark and bright parts is set to be in a range of 10 to 360 V.

6. The electrophotographic apparatus of claim 5, wherein the development contrast potential between exposed and non-exposed areas of the surface of the photosensitive drum in contact with the magnetic brush i.e., potential difference between dark and bright parts is set to be in a range of 10 to 240 V.

7. An electrophotographic apparatus with charging means for uniform charging including discharge phenomenon, exposure means and developing means for image formation by inversion development, these means being disposed on a photosensitive drum supported on a support or disposed inside the support, wherein: the photosensitive drum is an a-Si type photosensitive drum having thickness of substantially 2 to 25 μm except for a surface layer, and the surface potential on the photosensitive drum right after the charging thereof by the charging means is set to substantially 450 V or below, wherein a photoconductive layer in the photosensitive drum is formed as an a-Si layer having a temperature characteristic of 1.0 (V/°C.) or below, and image formation is obtainable without provision of any heater inside the support supporting the photosensitive drum but at the ambient temperature inside the apparatus.

8. The electrophotographic apparatus according to claim 7, wherein the thickness of a photoconductive layer in the photosensitive drum is set to 2 to 24 μm, and the surface potential on the photosensitive drum right after the charging thereof by the charging means is set to substantially 360 V or below.

9. The electrophotographic apparatus according to claim 7, wherein the thickness of a photoconductive layer in the photosensitive drum is set to 2 to 24 μm, and the surface potential on the photosensitive drum right after the charging thereof by the charging means is set to substantially 300 V or below.

10. An electrophotographic apparatus with exposure means disposed on a photosensitive drum, the drum being supported on a support or disposed inside the support, wherein: the photosensitive drum is an a-Si type photosensitive drum having thickness below a surface layer of substantially 2 to 25 μm or below, and the exposure means has a center exposure wavelength of 700 μm or above.

11. An electrophotographic apparatus with charging means for uniform charging including discharge phenomenon, exposure means, and developing means for image formation by inversion development, these means being disposed on a photosensitive drum supported on a support or disposed inside the support, wherein: the photosensitive drum is an a-Si type photosensitive drum having a thickness of substantially 2 to 25 μm except for a surface layer, the surface potential on the photosensitive drum right after the charging thereof by the charging means is set to substantially 450V or below, and a center exposure wavelength of the exposure means is set to 700 nm or above.

12. An electrophotographic apparatus with charging means for uniform charging including discharge phenomenon, exposure means, and developing means for image formation by inversion development, these means being disposed on a photosensitive drum supported on a support or disposed inside the support, wherein: a photoconductive layer in the photosensitive drum is formed as a thin film a-Si layer having a temperature characteristic of 1.0 (V/°C.) or below, the surface potential on the photosensitive drum right after the charging thereof by the charging means is set to substantially 450V or below, and image formation is obtainable without provision of any heater inside the support but at an ambient temperature in the apparatus.

13. An electrophotographic apparatus with exposure means and developing means both disposed on a photosensitive drum, the drum being supported on a support or inside the support, wherein: a photoconductive layer in the photosensitive drum is formed as an a-Si layer having a thickness of 2 to 24 μm, and the half sensitivity of the photosensitive drum necessary for the reduction of the exposure potential to one half the surface potential on the photoconductive layer is set to be in a range of 8 to 1 $cm^2/\mu J$.

14. The electrophotographic apparatus according to claim 13, wherein the exposure means includes a plastic lens having a refractive index of 1.51 or below as focusing lens.

15. An electrophotographic apparatus with charging means, exposure means and developing means successively disposed on a photosensitive drum, the drum being supported on a support or inside the support, wherein: a photoconductive layer in the photosensitive drum is formed as an a-Si layer having a thickness of 2 to 24 μm, the charging means uniformly charges the photosensitive drum and is particle charging means with charging particles thereof located on the photosensitive drum and frictionally movable relative to the photosensitive drum.

16. The electrophotographic apparatus according to claim 15, wherein the charging particles are magnetic particles.

17. The electrophotographic apparatus according to claim 15, wherein a DC bias is applied as charging bias to the particle charging means, the bias being set to 600V or below.

18. An electrophotographic apparatus, comprising:

an a-Si photosensitive drum having a thickness between 2 and 25 μm and an initial charging potential of not greater than 450V, an exposure device having a center exposure wavelength of not less than 700 nm, the photosensitive drum comprising a photoconductive layer formed as a thin film a-Si layer having a temperature characteristic of not greater than 1.0 V/°C., the photoconductive layer having a thickness d between 2 and 24 μm, a relative dielectric constant $\varepsilon r$ of not less than 2, and defining a ratio $d/\varepsilon r$ of not greater than 9, the photosensitive drum being formed on a conductive support and having a multi-layer structure, including a photoconductive layer, a carrier charge blocking layer for blocking introduction of carrier charge from the conductive support into the photoconductive layer, and at least one of an insulating layer and a high resistivity layer.

* * * * *